US009514867B2

(12) United States Patent
Harada et al.

(10) Patent No.: US 9,514,867 B2
(45) Date of Patent: Dec. 6, 2016

(54) CHIP RESISTOR AND METHOD FOR MAKING THE SAME

(71) Applicant: ROHM CO., LTD., Kyoto-shi, Kyoto (JP)

(72) Inventors: Kenichi Harada, Kyoto (JP); Masaki Yoneda, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 237 days.

(21) Appl. No.: 14/189,395

(22) Filed: Feb. 25, 2014

(65) Prior Publication Data

US 2014/0240083 A1 Aug. 28, 2014

(30) Foreign Application Priority Data

Feb. 26, 2013 (JP) ..... 2013-035801

(51) Int. Cl.

| | |
|---|---|
| ***H01C 1/012*** | (2006.01) |
| ***H01C 17/00*** | (2006.01) |
| ***H01C 1/08*** | (2006.01) |
| ***H01C 1/14*** | (2006.01) |

(52) U.S. Cl.

CPC ..... *H01C 17/006* (2013.01); *H01C 1/08* (2013.01); *H01C 1/14* (2013.01); *Y10T 29/49099* (2015.01); *Y10T 156/10* (2015.01)

(58) Field of Classification Search

CPC ..... H01C 13/00; H01C 17/006
USPC ..... 338/327–329, 332, 309, 313
See application file for complete search history.

(56) References Cited

U.S. PATENT DOCUMENTS 4,792,781 A * 12/1988 Takahashi ..... H01C 17/006 29/610.1
5,111,179 A * 5/1992 Flassayer ..... H01C 1/142 338/272
5,952,911 A * 9/1999 Kawase ..... H01C 1/142 338/22 R
6,166,620 A * 12/2000 Inuzuka ..... H01C 17/06533 338/308
6,943,662 B2 * 9/2005 Tanimura ..... H01C 1/142 257/537
7,659,806 B2 * 2/2010 Tamaki ..... H01C 1/14 338/307
7,982,582 B2 * 7/2011 Belman ..... H01C 17/288 338/307
8,035,476 B2 * 10/2011 Yang ..... H01C 1/032 338/309
8,044,765 B2 10/2011 Tsukada
(Continued)

FOREIGN PATENT DOCUMENTS

JP 2009-218552 9/2009

*Primary Examiner* — Kyung Lee
(74) *Attorney, Agent, or Firm* — Hamre, Schumann, Mueller & Larson. P.C.

(57) ABSTRACT

A chip resistor includes an insulating substrate, a resistor element arranged on the obverse surface of the substrate, a bonding layer provided between the resistor element and the substrate, a first electrode connected to the resistor element, and a second electrode connected to the resistor element. The second electrode is deviated from the first electrode in a direction perpendicular to the thickness direction of the substrate. The substrate includes a side surface between the obverse surface and the reverse surface. The first electrode covers the resistor element, and also the side surface and the reverse surface of the substrate.

35 Claims, 25 Drawing Sheets

(56) References Cited

U.S. PATENT DOCUMENTS

| | | | | |
|---|---|---|---|---|
| 8,081,059 | B2 * | 12/2011 | Tanimura | H01C 1/148<br>338/307 |
| 8,154,379 | B2 * | 4/2012 | Theissl | H01C 1/1406<br>338/22 R |
| 8,325,006 | B2 * | 12/2012 | Yoneda | H01C 1/028<br>338/309 |
| 2008/0094169 | A1 * | 4/2008 | Kinoshita | H01C 1/06<br>338/309 |

* cited by examiner

CHIP RESISTOR AND METHOD FOR MAKING THE SAME

BACKGROUND OF THE INVENTION

1. Field of the Invention

The present invention relates to a chip resistor and a method for making a chip resistor.

2. Description of the Related Art

Conventionally, chip resistors for use in electronic equipment are known. For instance, JP-A-2009-218552 discloses a chip resistor that includes a resistor element made of metal and two electrodes provided on the resistor element. In this chip resistor, however, the metal resistor element cannot be sufficiently small in thickness for ensuring proper mechanical strength of the device. Thus, the resistance of the conventional resistor cannot be made sufficiently high.

SUMMARY OF THE INVENTION

The present invention has been proposed under the circumstances described above. It is therefore an object of the present invention to provide a chip resistor having increased resistance without compromising the mechanical strength of the device.

According to a first aspect of the present invention, there is provided a chip resistor comprising an insulating substrate including a substrate obverse surface and a substrate reverse surface, a resistor element arranged on the substrate obverse surface, a bonding layer provided between the resistor element and the substrate obverse surface, a first electrode connected to the resistor element, and a second electrode connected to the resistor element. The second electrode is at a position deviated from the first electrode to a second direction opposite from a first direction perpendicular to a thickness direction of the substrate. The substrate includes a first substrate side surface facing in the first direction. The first electrode covers the resistor element, the first substrate side surface and the substrate reverse surface.

Preferably, the first electrode includes abase layer and a connecting layer. The base layer is formed on the substrate reverse surface. The connecting layer directly covers the base layer, the first substrate side surface and the resistor element.

Preferably, the base layer is provided between the connecting layer and the substrate reverse surface.

Preferably, the connecting layer is 0.5-1.0 nm in thickness.

Preferably, the connecting layer is formed by PVD or CVD.

Preferably, the PVD comprises sputtering.

Preferably, the resistor element is in the form of a serpentine as viewed in the thickness direction of the substrate.

Preferably, the resistor element includes a resistor element side surface facing in the first direction, and the resistor element side surface is directly covered by the connecting layer.

Preferably, the resistor element includes a resistor element obverse surface facing in the same direction as the substrate obverse surface, and the resistor element obverse surface is directly covered by the connecting layer.

Preferably, the bonding layer includes a bonding layer obverse surface facing in the same direction as the substrate obverse surface, and the bonding layer obverse surface is in direct contact with the resistor element.

Preferably, the bonding layer obverse surface includes a region deviated from the resistor element side surface to the first direction, and the region is directly covered by the connecting layer.

Preferably, the first electrode includes a plating layer covering the connecting layer.

Preferably, the plating layer includes a Cu layer covering the connecting layer, an Ni layer covering the Cu layer and an Sn layer covering the Ni layer.

Preferably, the substrate includes a first inclined surface inclined with respect to the thickness direction so as to form an obtuse angle with the substrate obverse surface. The first inclined surface is connected to the substrate obverse surface and the first substrate side surface and covered by the bonding layer.

Preferably, the substrate includes a second inclined surface inclined with respect to the thickness direction so as to form an obtuse angle with the substrate reverse surface. The second inclined surface is connected to the substrate reverse surface and the first substrate side surface and covered by the base layer.

Preferably, the dimension of the first inclined surface in the thickness direction of the substrate is larger than the dimension of the second inclined surface in the thickness direction of the substrate.

Preferably, the substrate includes a second substrate side surface facing in the second direction, and the second electrode covers the resistor element, the second substrate side surface and the substrate reverse surface.

Preferably, the substrate includes a third substrate side surface and a fourth substrate side surface facing away from each other. The third substrate side surface faces in a third direction perpendicular to the thickness direction of the substrate and the first direction. Both of the third substrate side surface and the fourth substrate side surface are exposed.

Preferably, the chip resistor further comprises an insulating protective film covering the resistor element. The protective film is in direct contact with the first electrode and the second electrode.

Preferably, the base layer is made of Ag.

Preferably, the substrate is made of a ceramic material or a resin.

Preferably, the bonding layer is made of an epoxy-based material.

Preferably, the resistor element is made of Cu—Mn—Ni alloy sold under MANGANIN®, Cu—Mn—Sn alloy sold under ZERANIN®, Ni—Cr alloy, Cu—Ni alloy or Fe—Cr alloy.

According to a second aspect of the present invention, there is provided a method for making a chip resistor provided according to the first aspect of the present invention. The method comprises the step of bonding a resistor element material on a sheet obverse surface of an insulating substrate sheet by using a bonding material.

Preferably, the method further comprises the step of forming an electrically conductive base layer on a sheet reverse surface of the substrate sheet.

Preferably, the step of forming the base layer is performed by printing.

Preferably, the base layer is made of Ag.

Preferably, the bonding material comprises an adhesive sheet or an adhesive in a liquid state.

Preferably, the method further comprises the step of forming an insulating protective film for covering the resistor element material.

Preferably, the method further comprises the step of dividing the substrate sheet into a plurality of bars.

Preferably, each of the bars includes an elongated bar side surface. The method further comprises the step of applying an electrically conductive material to the bar side surface.

Preferably, the step of applying an electrically conductive material is performed by PVD or CVD.

Preferably, the PVD comprises sputtering.

Preferably, the application step comprises applying an electrically conductive material collectively to the bar side surfaces of the plurality of bars.

Preferably, a plurality of grooves are formed in each of the sheet obverse surface and the sheet reverse surface of the substrate sheet. The step of dividing into a plurality of bars comprises dividing the substrate sheet along the grooves.

Preferably, the method further comprises the step of dividing the bars along a width direction of the bars into individual pieces.

Preferably, the method further comprises the step of plating the individual pieces to form a plating layer after the step of dividing into individual pieces.

Other features and advantages of the present invention will become more apparent from detailed description given below with reference to the accompanying drawings.

DESCRIPTION OF THE PREFERRED EMBODIMENTS

Figure 1:
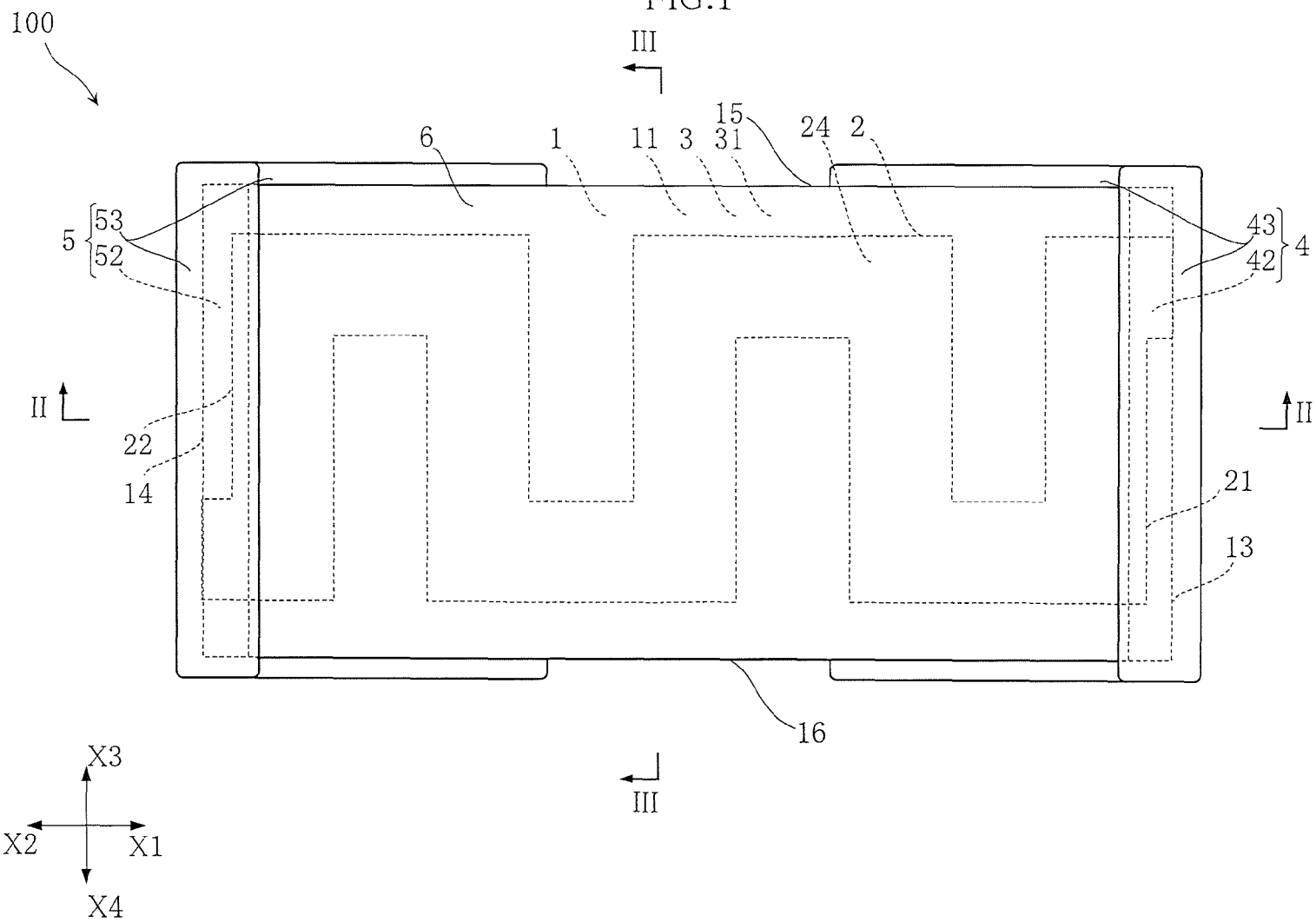
FIG. 1 is a plan view of a chip resistor according to a first embodiment of the present invention.

Embodiments of the present invention are described below with reference to the accompanying drawings.

An embodiment of the present invention is described below with reference to FIGS. 1-25.

The chip resistor 100 shown in these figures includes a substrate 1, a resistor element 2, a bonding layer 3, a first electrode 4, a second electrode 5 and a protective film 6.

Figure 2:
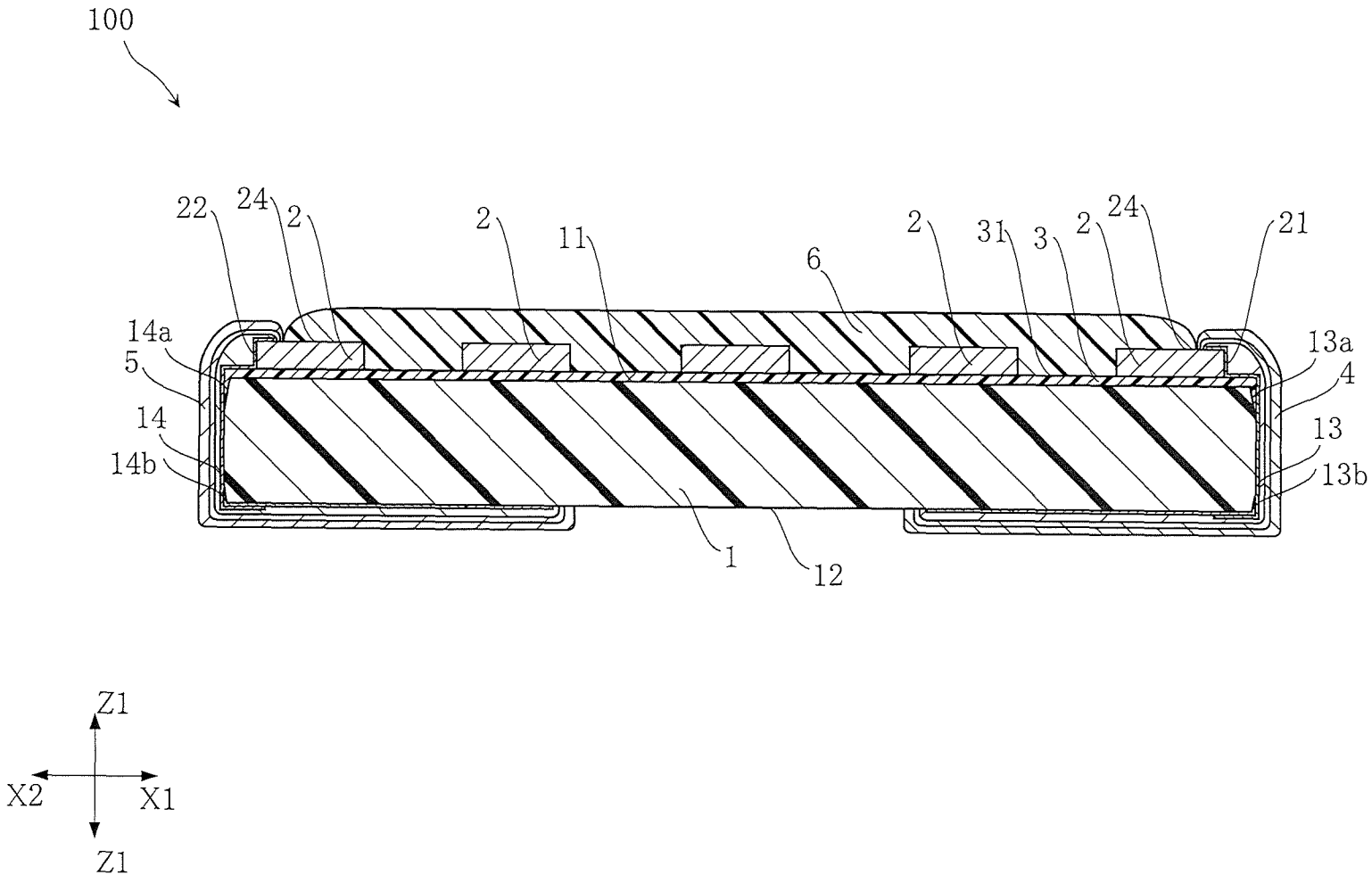
FIG. 2 is a sectional view taken along lines II-II in FIG. 1.

The substrate 1 is in the form of a plate and has insulating properties. For instance, the substrate 1 is made of a ceramic material or a resin. Examples of the ceramic material include $Al_2O_3$, AlN and SiC. In order that heat generated at the resistor element 2 can easily dissipate to the outside of the chip resistor 100, it is preferable to use a material having a high thermal conductivity for forming the substrate 1. The substrate 1 has a substrate obverse surface 11, a substrate reverse surface 12, a first substrate side surface 13, a second substrate side surface 14, a third substrate side surface 15 and a fourth substrate side surface 16. All of the substrate obverse surface 11, the substrate reverse surface 12, the first substrate side surface 13, the second substrate side surface 14, the third substrate side surface 15 and the fourth substrate side surface 16 are flat. As shown in FIG. 2, the vertical direction in the figure is defined as the thickness direction Z1 of the substrate 1. As shown in FIG. 1, the right direction in the figure is defined as the first direction X1, the left direction in the figure is defined as the second direction X2, the upward direction in the figure is defined as the third direction X3 and the downward direction in the figure is defined as the fourth direction X4. For instance, the thickness (the dimension in the thickness direction Z1) of the substrate 1 is 100-500 μm.

For instance, the dimension of the chip resistor 100 in the first direction X1 is 5-10 mm and the dimension of the chip resistor 100 in the third direction X3 is 2-10 mm.

The substrate obverse surface 11 and the substrate reverse surface 12 face away from each other. The first substrate side surface 13 faces in the first direction X1. The second substrate side surface 14 faces in the second direction X2. That is, the first substrate side surface 13 and the second substrate side surface 14 face away from each other. The third substrate side surface 15 faces in the third direction X3. The fourth substrate side surface 16 faces in the fourth direction X4. That is, the third substrate side surface 15 and the fourth substrate side surface 16 face away from each other.

As shown in FIGS. 2, 3, 9 and 10, in this embodiment, the substrate 1 has first inclined surfaces 13*a*, 14*a*, 15*a*, 16*a* and second inclined surfaces 13*b*, 14*b*, 15*b*, 16*b*. Each of the first inclined surfaces 13*a*, 14*a*, 15*a*, 16*a* is inclined with respect to the thickness direction Z1 so as to form an obtuse angle with the substrate obverse surface 11. Each of the second inclined surfaces 13*b*, 14*b*, 15*b*, 16*b* is inclined with respect to the thickness direction Z1 so as to form an obtuse angle with the substrate reverse surface 12. The first inclined surface 13*a* is connected to the substrate obverse surface 11 and the first substrate side surface 13. The first inclined surface 14*a* is connected to the substrate obverse surface 11 and the second substrate side surface 14. The first inclined surface 15*a* is connected to the substrate obverse surface 11 and the third substrate side surface 15. The first inclined surface 16*a* is connected to the substrate obverse surface 11 and the fourth substrate side surface 16. The second inclined surface 13*b* is connected to the substrate reverse surface 12 and the first substrate side surface 13. The second inclined surface 14*b* is connected to the substrate reverse surface 12 and the second substrate side surface 14. The second inclined surface 15*b* is connected to the substrate reverse surface 12 and the third substrate side surface 15. The second inclined surface 16*b* is connected to the substrate reverse surface 12 and the fourth substrate side surface 16. In this embodiment, the dimensions of the first inclined surfaces 13*a*, 14*a*, 15*a*, 16*a* in the thickness direction Z1 are larger than the dimensions of the second inclined surfaces 13*b*, 14*b*, 15*b*, 16*b* in the thickness direction Z1.

Unlike this embodiment, the substrate 1 may not be formed with the first inclined surfaces 13*a*, 14*a*, 15*a*, 16*a* or the second inclined surfaces 13*b*, 14*b*, 15*b*, 16*b*.

As shown in FIG. 2, the resistor element 2 is arranged on the substrate 1. Specifically, the resistor element 2 is arranged on the substrate obverse surface 11 of the substrate 1. For instance, the thickness (the dimension in the thickness direction Z1) of the resistor element 2 is 50-200 μm. In this embodiment, the resistor element 2 is in the form of a serpentine as viewed in the thickness direction Z1. The serpentine shape of the resistor element 2 is advantageous to increase the resistance of the resistor element 2. However, unlike this embodiment, the resistor element 2 may not be in the form of a serpentine but may be in the form of a strip elongated in the X1-X2 direction.

The resistor element 2 is made of resistive metal such as Cu—Mn—Ni alloy sold under MANGANIN®, Cu—Mn—Sn alloy sold under ZERANIN®, Ni—Cr alloy, Cu—Ni alloy or Fe—Cr alloy.

Figure 3:
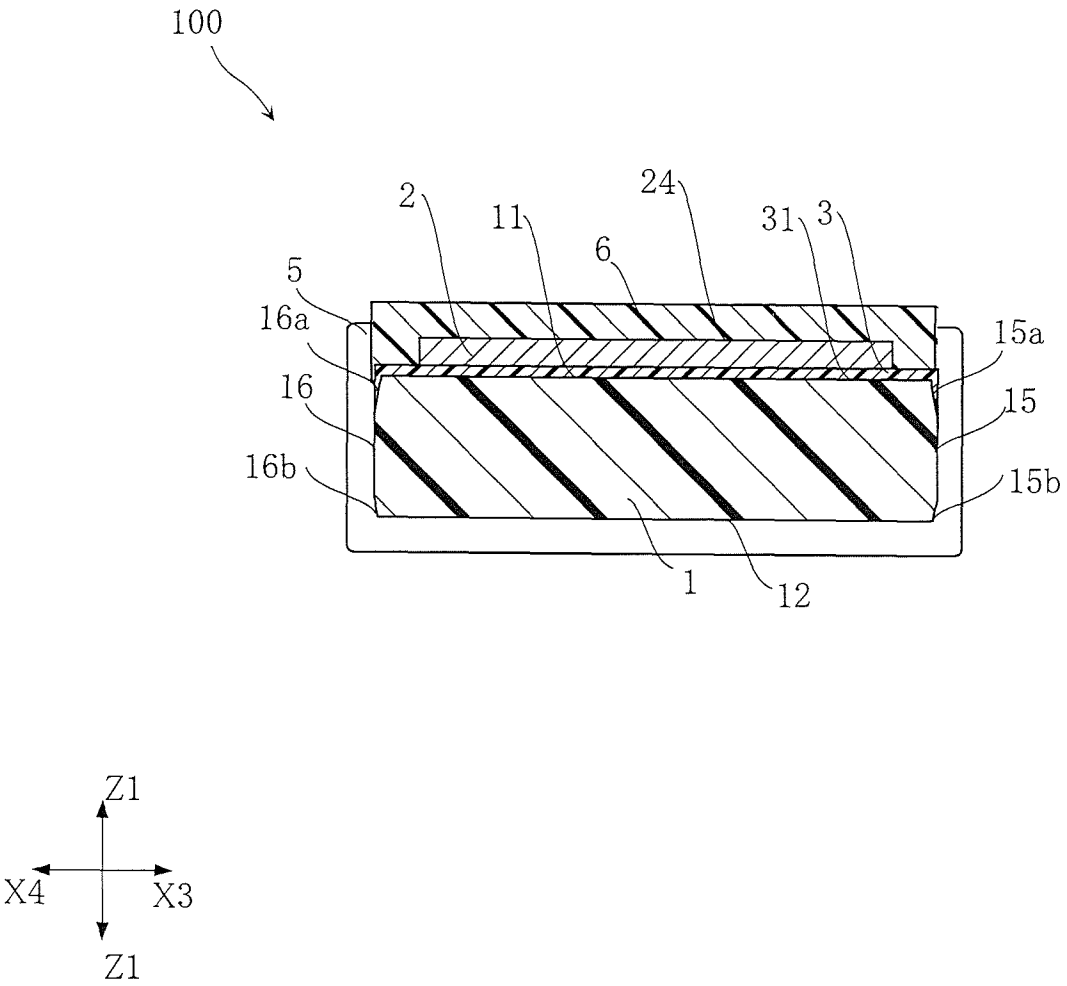
FIG. 3 is a sectional view taken along lines III-III in FIG. 1.
Figure 4:
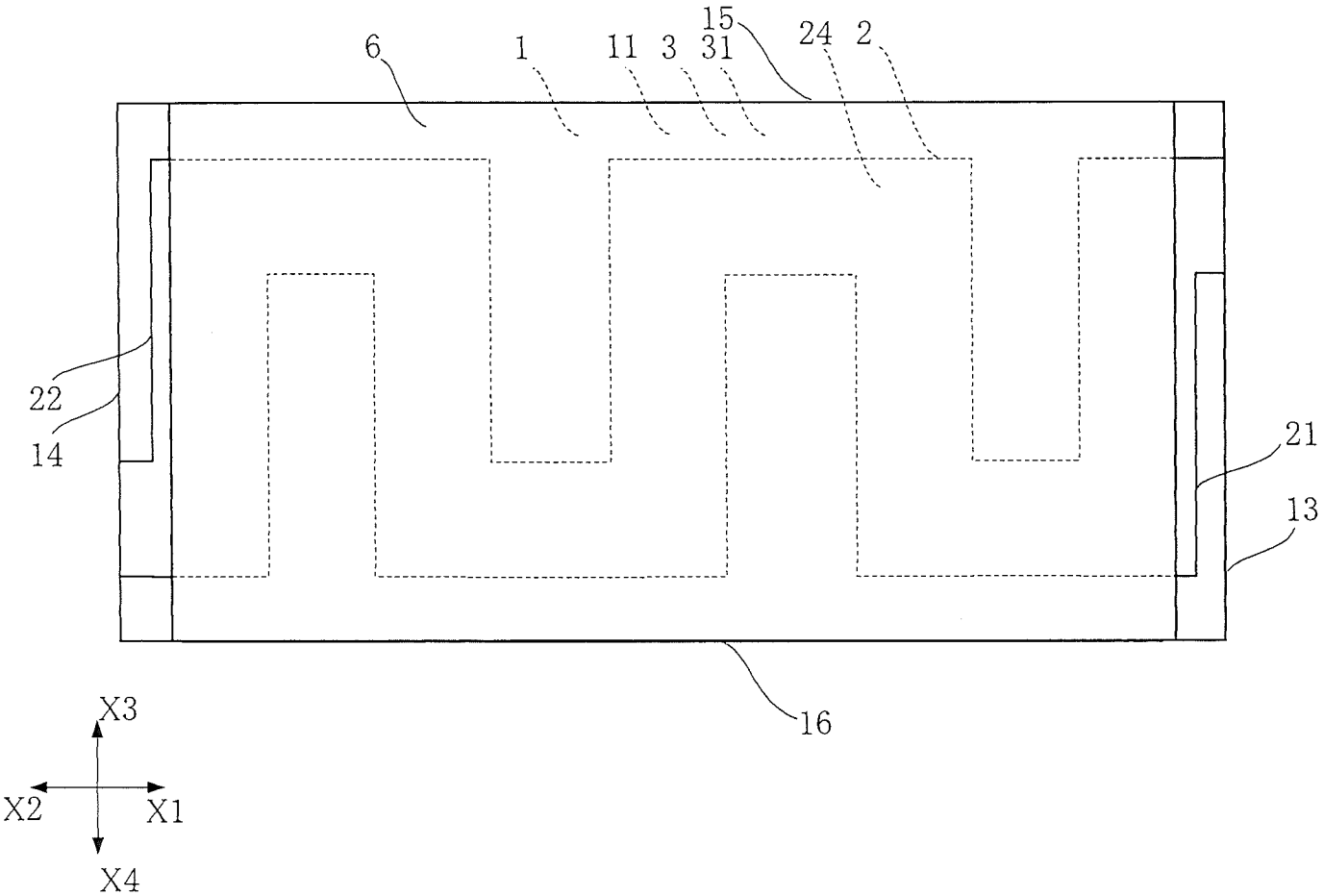
FIG. 4 is a plan view obtained by omitting a first electrode and a second electrode from FIG. 1.
Figure 5:
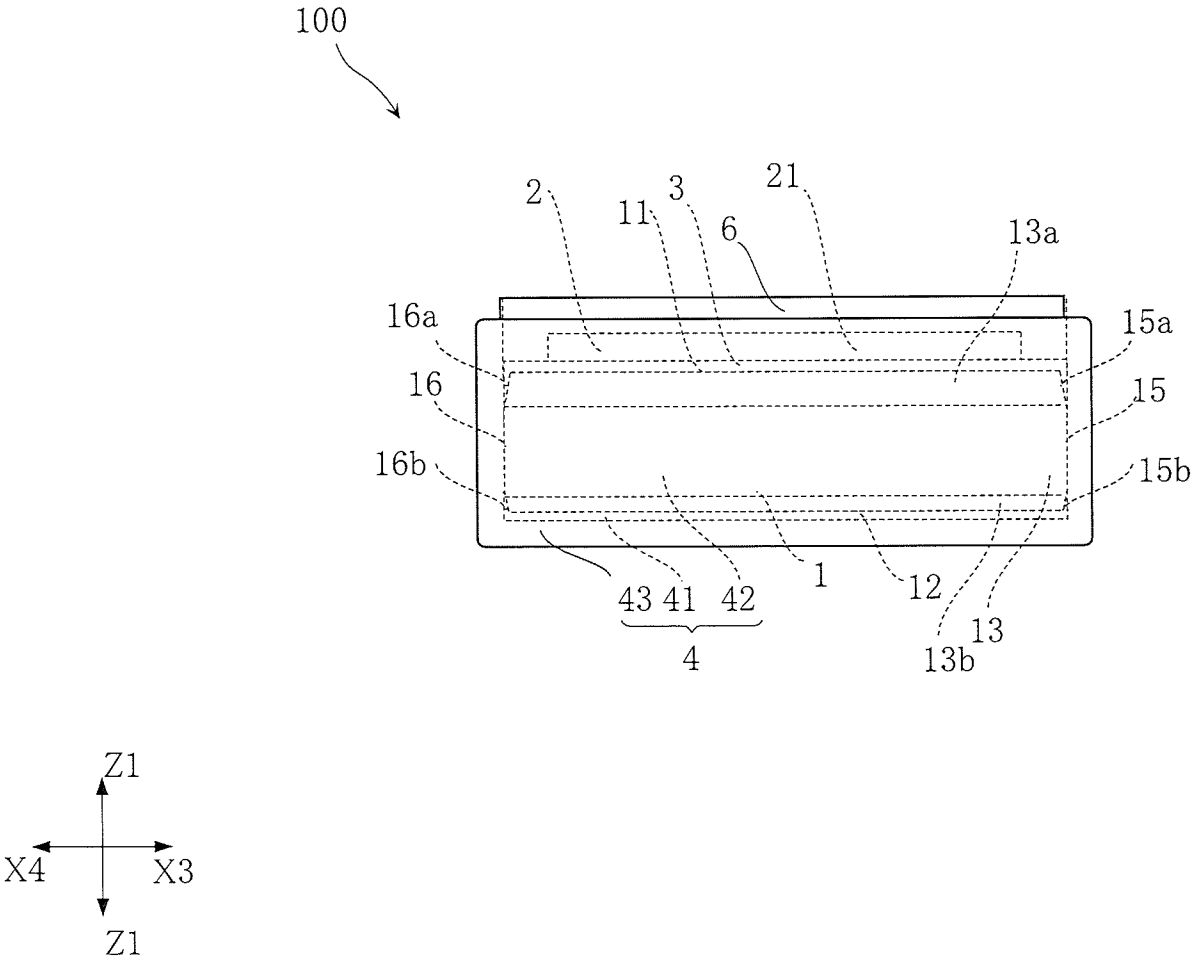
FIG. 5 is a right side view of the chip resistor shown in FIG. 1.
Figure 6:
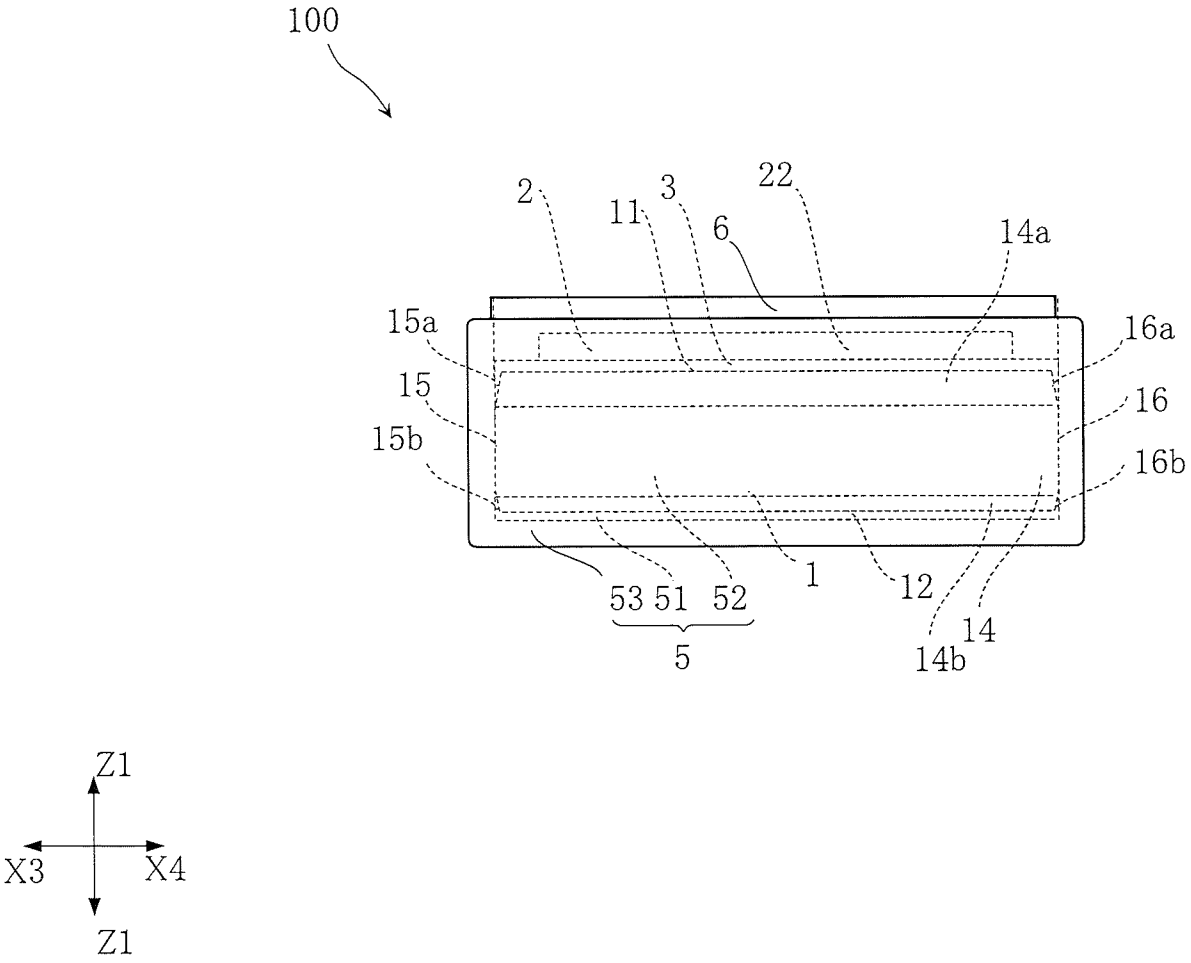
FIG. 6 is a left side view of the chip resistor shown in FIG. 1.

As shown in FIGS. 2 and 3, the resistor element 2 has a first resistor element side surface 21, a second resistor element side surface 22 and a resistor element obverse surface 24. The first resistor element side surface 21 faces in the first direction X1. In this embodiment, the first resistor element side surface 21 is deviated from the first substrate side surface 13 in the second direction X2 (in FIG. 2, to the left). The second resistor element side surface 22 faces in the second direction X2. In this embodiment, the second resistor element side surface 22 is deviated from the second substrate side surface 14 in the first direction X1 (in FIG. 2, to the right). The resistor element obverse surface 24 faces in the same direction as the substrate obverse surface 11 (i.e., upward in FIG. 2).

The bonding layer 3 is provided between the substrate 1 and the resistor element 2. Specifically, the bonding layer 3 is provided between the substrate obverse surface 11 of the substrate 1 and the resistor element 2. The bonding layer 3 bonds the resistor element 2 to the substrate obverse surface 11. Preferably, the bonding layer 3 is made of an insulating material. For instance, an epoxy-based material may be used as the insulating material. It is preferable that the material forming the bonding layer 3 has high thermal conductivity so that heat generated at the resistor element 2 easily dissipates to the outside of the chip resistor 100 through the bonding layer 3 and the substrate 1. For instance, the thermal conductivity of the material forming the bonding layer 3 is 1-15 W/(m·K). For instance, the thickness (dimension in the thickness direction Z1) of the bonding layer 3 is 30-100 μm. As shown in FIGS. 2 and 3, in this embodiment, the bonding layer 3 covers the entirety of the substrate obverse surface 11. Also, in this embodiment, the bonding layer 3 covers the first inclined surfaces 13*a*, 14*a*, 15*a*, 16*a*.

Unlike this embodiment, the bonding layer 3 may be formed only at a part of the substrate obverse surface 11. For instance, the bonding layer 3 may be formed only at a region of the substrate obverse surface 11 which overlaps the resistor element 2.

As shown in FIGS. 2 and 3, the bonding layer 3 has a bonding layer obverse surface 31. The bonding layer obverse surface 31 faces in the same direction as the substrate obverse surface 11 (i.e., upward in FIG. 2). The bonding layer obverse surface 31 is in direct contact with the resistor element 2.

The first electrode 4 is electrically connected to the resistor element 2. The first electrode 4 covers the resistor element 2, the first substrate side surface 13 and the substrate reverse surface 12. The first electrode 4 is provided for supplying electric power from a wiring board (not shown) on which the chip resistor 100 is mounted to the resistor element 2.

Figure 9:
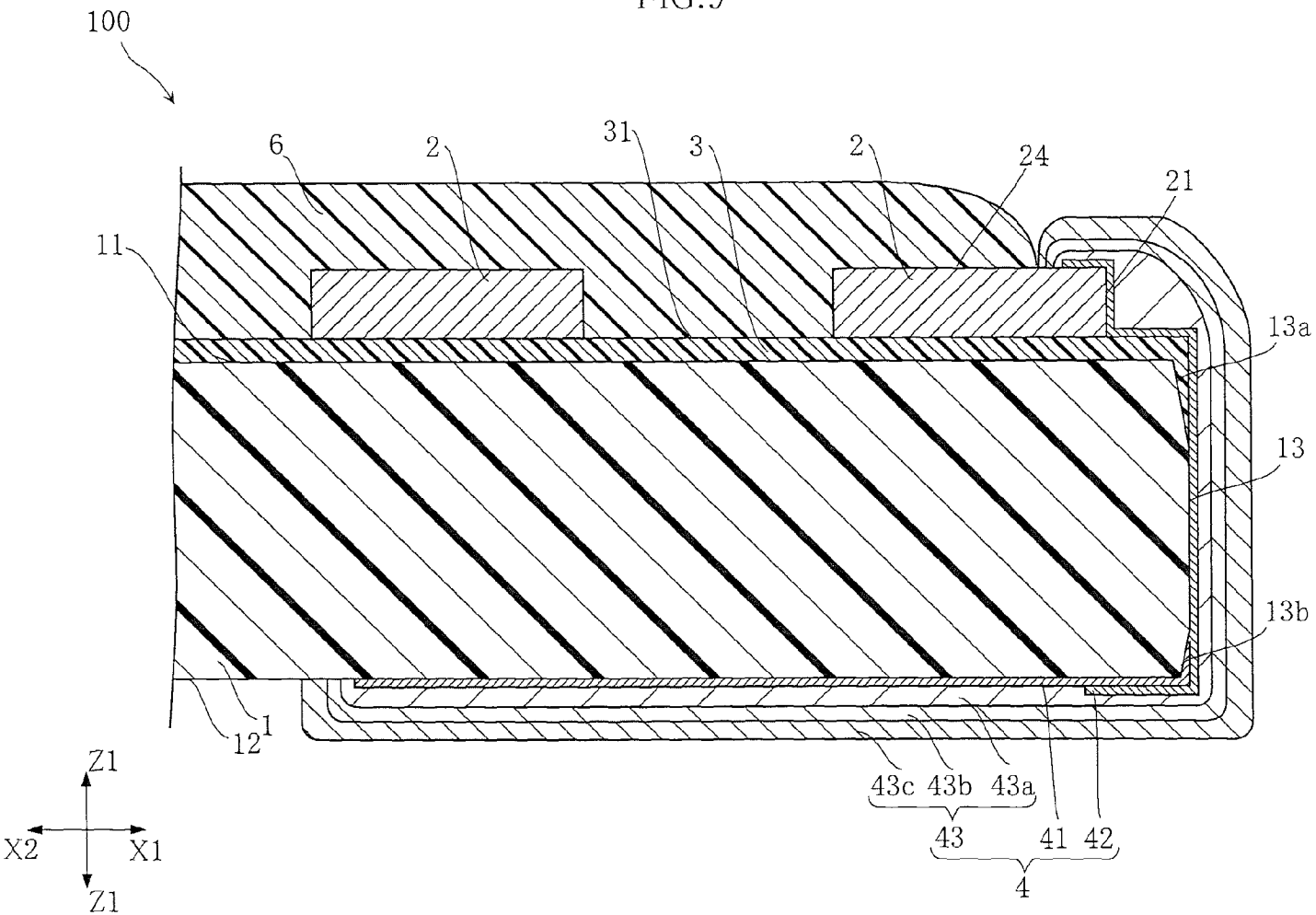
FIG. 9 is a partially enlarged sectional view of the chip resistor shown in FIG. 2.

As shown in FIG. 9, the first electrode 4 includes a first base layer 41, a first connecting layer 42 and a first plating layer 43.

The first base layer 41 is formed on the substrate reverse surface 12. The first base layer 41 may be formed by e.g. printing. The first base layer 41 may be made of Ag or Cu. When the first base layer 41 is to be formed in the atmosphere, the use of Ag is preferable. The first base layer 41 is formed on the entirety of the substrate reverse surface 12 in the X3-X4 direction. In this embodiment, the first base layer 41 is formed on the second inclined surface 13*b*, a part of the second inclined surface 15*b* and a part of the second inclined surface 16*b*.

The first connecting layer 42 directly covers the first base layer 41, the first substrate side surface 13 and the resistor element 2. The first connecting layer 42 electrically connects the first base layer 41 and the resistor element 2 to each other. Since the first connecting layer 42 is provided, the first plating layer 43 is to be formed properly on the first substrate side surface 13 by plating. The first base layer 41 is provided between the first connecting layer 42 and the substrate reverse surface 12. The first connecting layer 42 directly covers the first resistor element side surface 21 and the resistor element obverse surface 24 of the resistor element 2. In this embodiment, the first connecting layer 42 directly covers a region of the bonding layer obverse surface 31 which is deviated from the first resistor element side surface 21 in the first direction X1. Also, in this embodiment, the first connecting layer 42 directly covers a portion of the bonding layer 3 which is on the first inclined surface 13*a* and a portion of the first base layer 41 which is on the second inclined surface 13*b*. The first connecting layer 42 is formed on the entirety of the first substrate side surface 13 in the X3-X4 direction. The first connecting layer 42 contains e.g. Ni or Cr. For instance, the first connecting layer 42 is 0.5-1.0 nm in thickness.

The first plating layer 43 directly covers the first base layer 41 and the first connecting layer 42. The first plating layer 43 is formed on the first substrate side surface 13 and the resistor element 2. The first plating layer 43 is exposed to the outside. Specifically, in this embodiment, the first plating layer 43 includes a Cu layer 43*a*, an Ni layer 43*b* and an Sn layer 43*c*. The Cu layer 43*a* directly covers the first base layer 41 and the first connecting layer 42. The Ni layer 43*b* directly covers the Cu layer 43*a*. The Sn layer 43*c* directly covers the Ni layer 43*b*. The Sn layer 43*c* is exposed to the outside. In mounting the chip resistor 100, solder adheres to the Sn layer 43*c*. For instance, the Cu layer 43*a* is 10-50 μm in thickness, the Ni layer 43*b* is 1-10 μm in thickness, and the Sn layer 43*c* is 1-10 μm in thickness.

Figure 10:
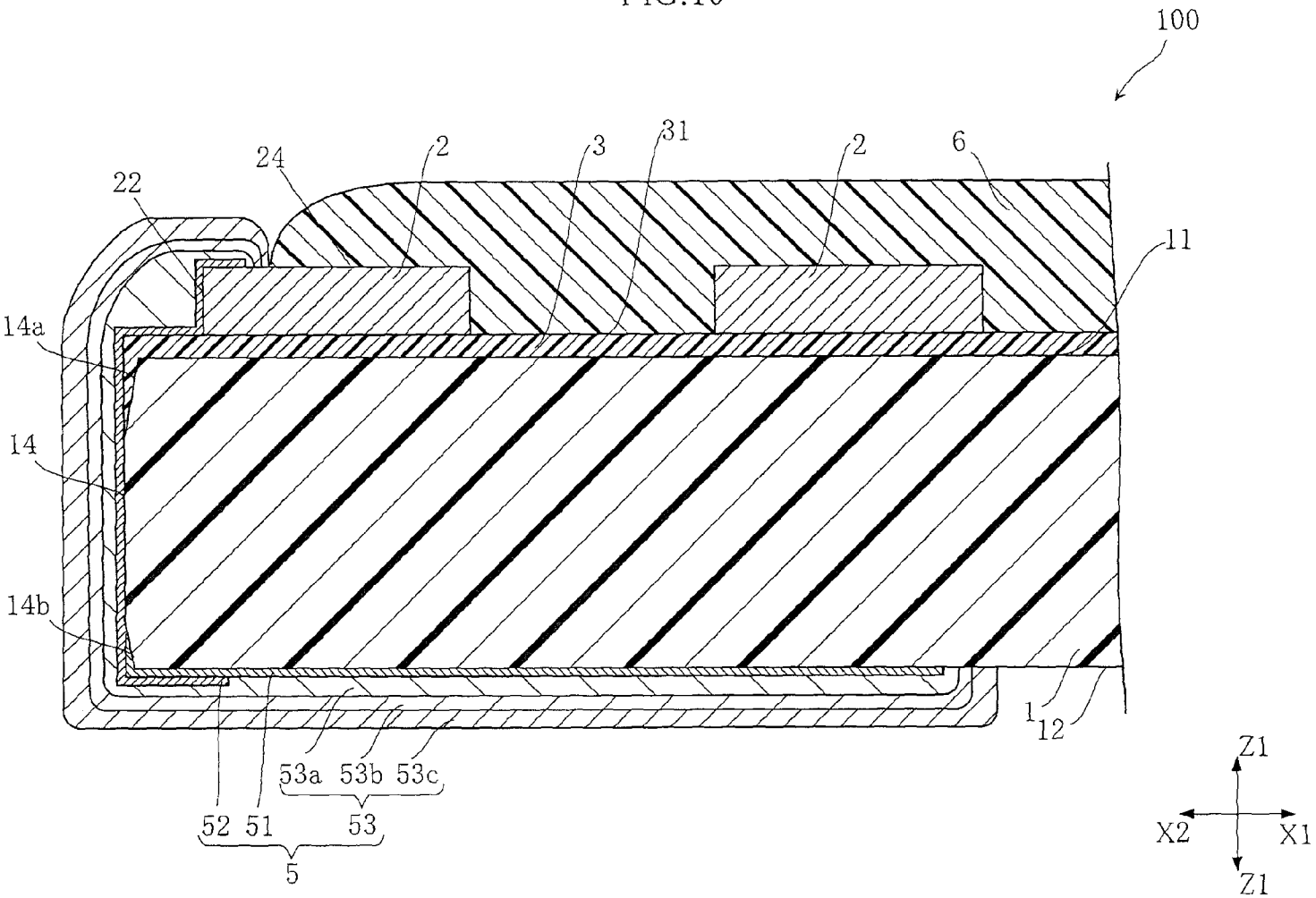
FIG. 10 is a partially enlarged sectional view of the chip resistor shown in FIG. 2.

As shown in FIG. 10, the second electrode 5 is electrically connected to the resistor element 2. The second electrode 5 covers the resistor element 2, the second substrate side surface 14 and the substrate reverse surface 12. The second electrode 5 is provided for supplying electric power from a wiring board (not shown) on which the chip resistor 100 is mounted to the resistor element 2.

The second electrode 5 includes a second base layer 51, a second connecting layer 52 and a second plating layer 53.

The second base layer 51 is formed on the substrate reverse surface 12. The second base layer 51 may be formed by e.g. printing. The second base layer 51 may be made of Ag or Cu. When the second base layer 51 is to be formed in the atmosphere, the use of Ag is preferable. The second base layer 51 is formed on the entirety of the substrate reverse surface 12 in the X3-X4 direction. In this embodiment, the second base layer 51 is formed on the second inclined surface 14*b*, a part of the second inclined surface 15*b* and a part of the second inclined surface 16*b*.

The second connecting layer 52 directly covers the second base layer 51, the second substrate side surface 14 and the resistor element 2. The second connecting layer 52 electrically connects the second base layer 51 and the resistor element 2 to each other. Since the second connecting layer 52 is provided, the second plating layer 53 is to be formed properly on the second substrate side surface 14 by plating. The second base layer 51 is provided between the second connecting layer 52 and the substrate reverse surface 12. The second connecting layer 52 directly covers the second resistor element side surface 22 and the resistor element obverse surface 24 of the resistor element 2. In this embodiment, the second connecting layer 52 directly covers a region of the bonding layer obverse surface 31 which is deviated from the second resistor element side surface 22 in the second direction X2. Also, in this embodiment, the second connecting layer 52 directly covers a portion of the bonding layer 3 which is on the first inclined surface 14*a* and a portion of the second base layer 51 which is on the second inclined surface 14*b*. The second connecting layer 52 is formed on the entirety of the second substrate side surface 14 in the X3-X4 direction. For instance, the second connecting layer 52 is 0.5-1.0 nm in thickness.

The second plating layer 53 directly covers the second base layer 51 and the second connecting layer 52. The second plating layer 53 is formed on the second substrate side surface 14 and the resistor element 2. The second plating layer 53 is exposed to the outside. Specifically, in this embodiment, the second plating layer 53 includes a Cu layer 53*a*, an Ni layer 53*b* and an Sn layer 53*c*. The Cu layer 53*a* directly covers the second base layer 51 and the second connecting layer 52. The Ni layer 53*b* directly covers the Cu layer 53*a*. The Sn layer 53*c* directly covers the Ni layer 53*b*. The Sn layer 53*c* is exposed to the outside. In mounting the chip resistor 100, solder adheres to the Sn layer 53*c*. For instance, the Cu layer 53*a* is 10-50 μm in thickness, the Ni layer 53*b* is 1-10 μm in thickness, and the Sn layer 53*c* is 1-10 μm in thickness.

The protective film 6 has insulating properties and covers the resistor element 2. In this embodiment, the protective film 6 directly covers the bonding layer 3 (specifically, the bonding layer obverse surface 31 of the bonding layer 3). The protective film 6 is in contact with the first electrode 4 and the second electrode 5. For instance, the protective film 6 is made of a thermosetting material. For instance, the maximum thickness of the protective film 6 (maximum dimension in the thickness direction Z1) is 100-250 μm.

Figure 7:
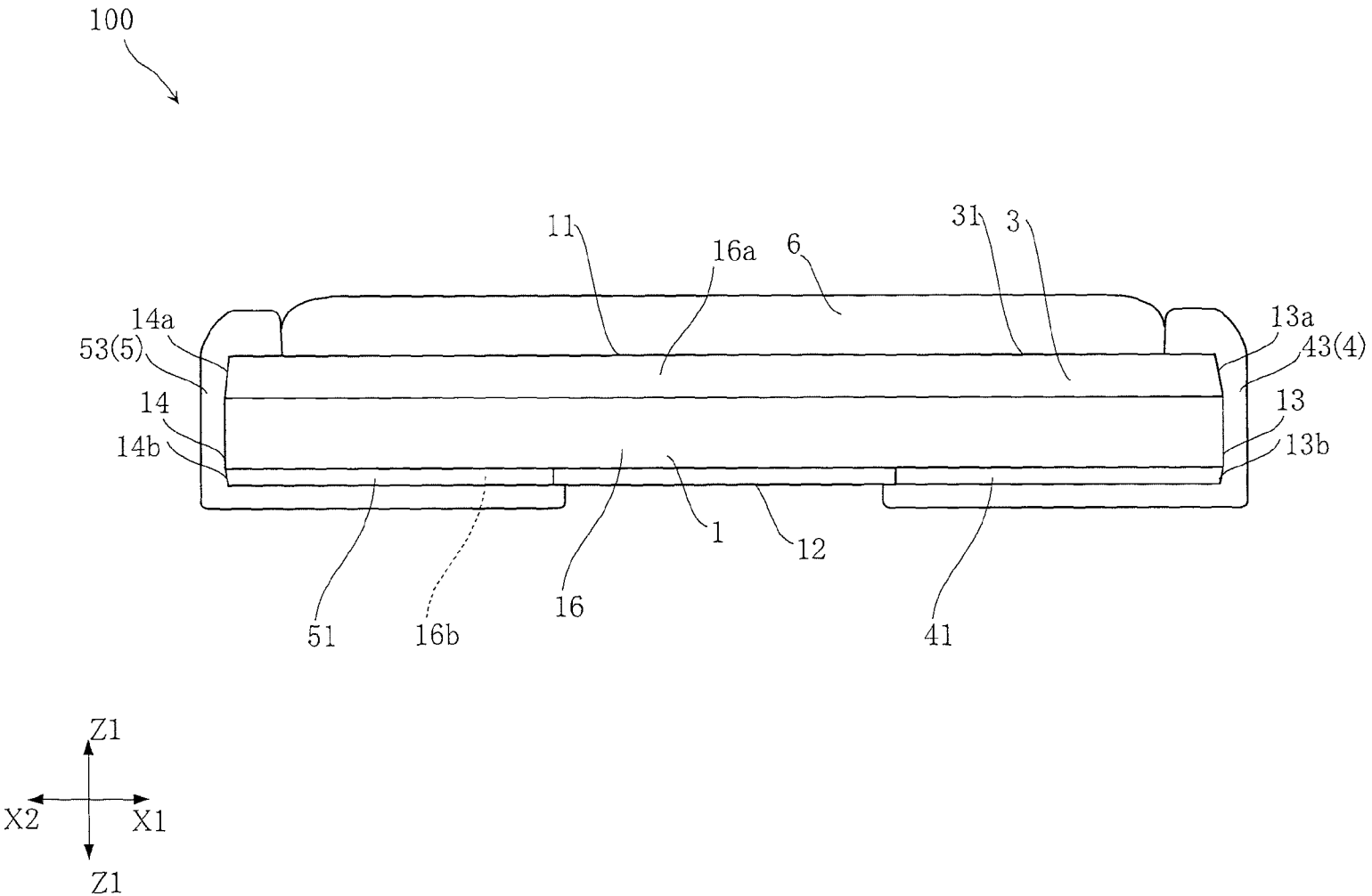
FIG. 7 is a front view of the chip resistor shown in FIG. 1.
Figure 8:
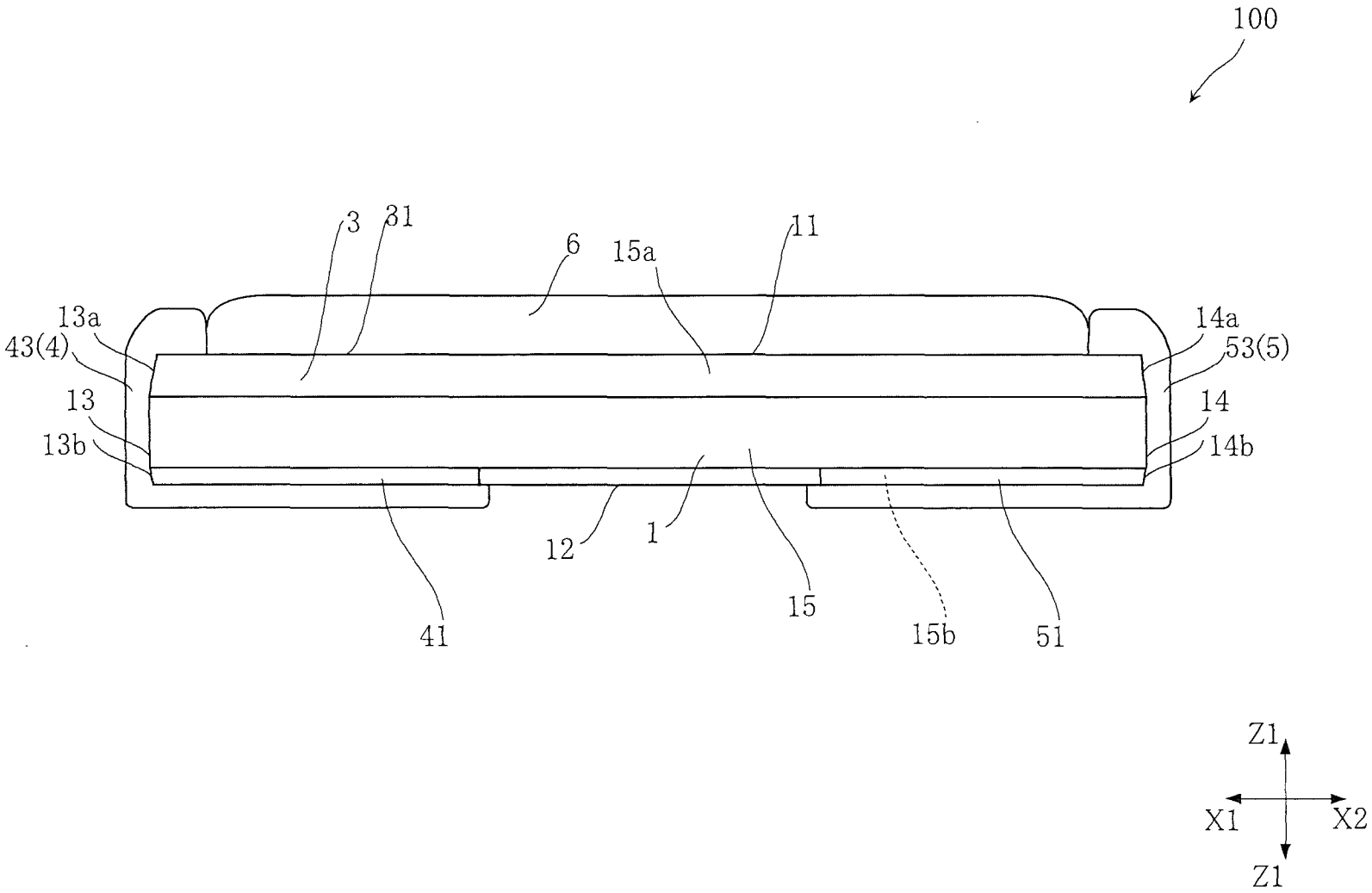
FIG. 8 is a rear view of the chip resistor shown in FIG. 1.

As shown in FIGS. 7 and 8, in the chip resistor 100, each of the third substrate side surface 15 and the fourth substrate side surface 16 has a portion at which none of the first electrode 4, the second electrode 5 and the protective film 6 are formed. Thus, at least a part of the third substrate side surface 15 (entirety in this embodiment) and at least a part of the fourth substrate side surface 16 (entirety in this embodiment) are exposed.

A method for making the chip resistor 100 is described below.

Figure 11:
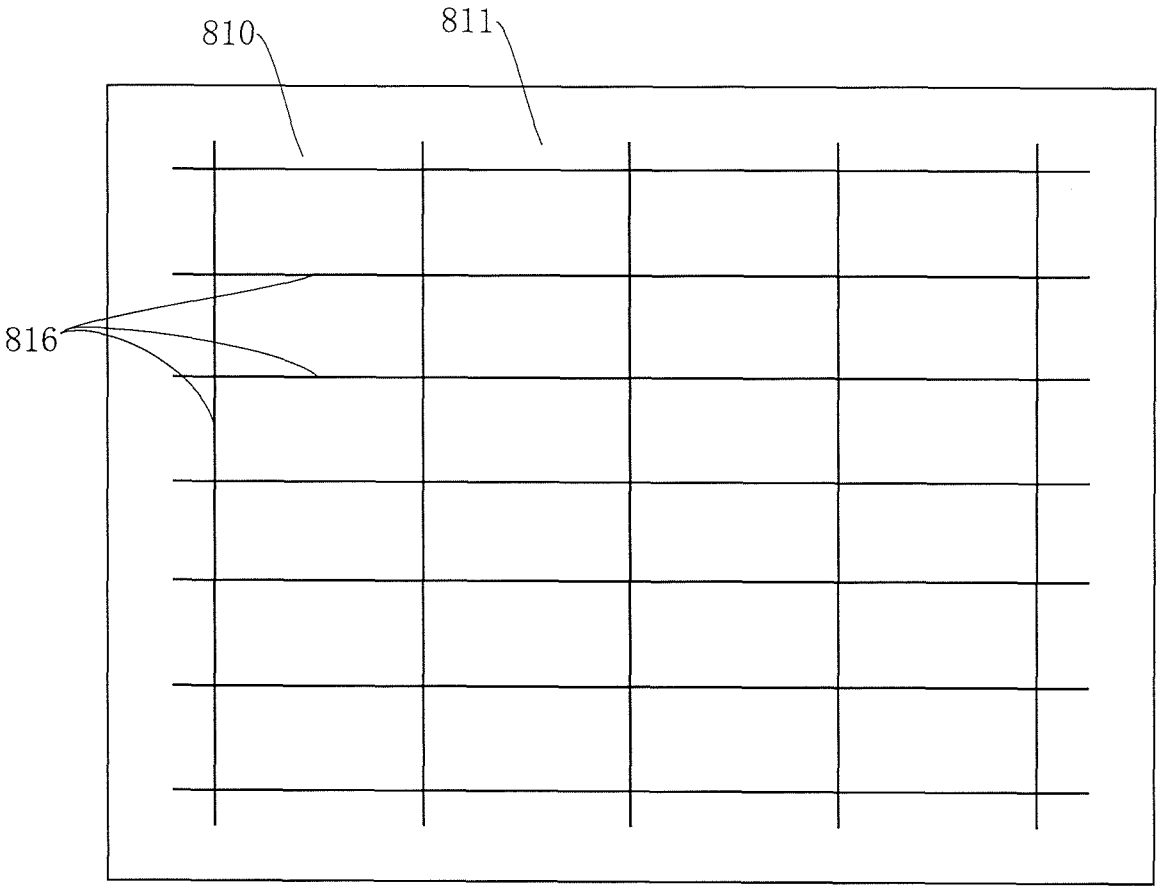
FIG. 11 is a plan view showing a step of a method for making the chip resistor shown in FIG. 1.
Figure 12:
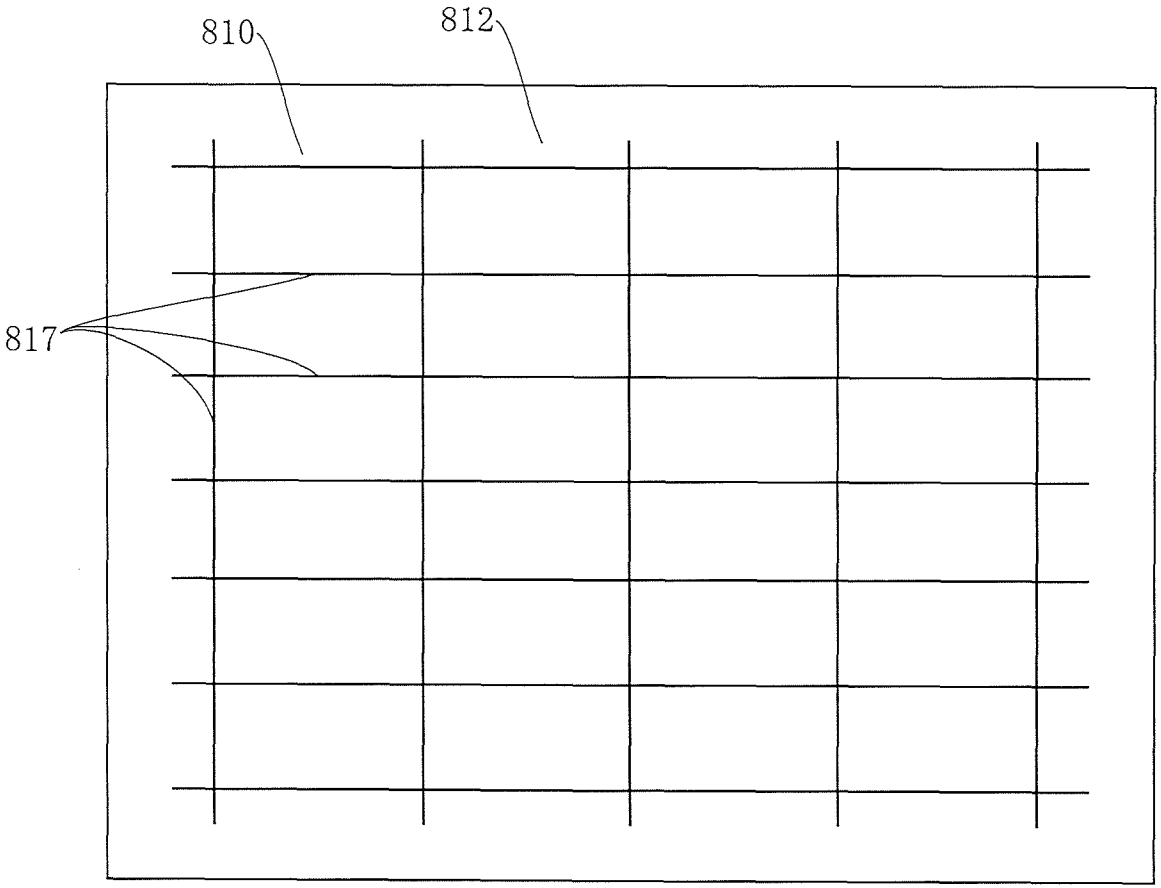
FIG. 12 is a reverse side view showing a step of a method for making the chip resistor shown in FIG. 1.

First, as shown in FIGS. 11 and 12, a substrate sheet 810 is prepared. FIG. 11 shows the sheet obverse surface 811 of the substrate sheet 810, whereas FIG. 12 shows the sheet reverse surface 812 of the substrate sheet 810. The substrate sheet 810 is to become the above-described substrate 1. The substrate sheet 810 is made of an insulating material. The substrate sheet 810 is made of a ceramic material or a resin. Examples of the ceramic material include $Al_2O_3$, AlN and SiC. The substrate sheet 810 is formed with grooves 816 and grooves 817. The grooves 816 and 817 are formed in a grid pattern. The grooves 816 are formed in the sheet obverse surface 811 of the substrate sheet 810. The inner surfaces of the grooves 816 (not shown in FIG. 11) become the above-described first inclined surfaces 13*a*, 14*a*, 15*a*, 16*a*. The grooves 817 are formed in the sheet reverse surface 812 of the substrate sheet 810. The inner surfaces of the grooves 817 (not shown in FIG. 12) become the above-described second inclined surfaces 13*b*, 14*b*, 15*b*, 16*b*. In this embodiment, the depth of the grooves 816 is larger than the depth of the grooves 817 (see FIG. 14, which will be referred to later) so that the dimensions of the first inclined surfaces 13*a*, 14*a*, 15*a*, 16*a* in the thickness direction Z1 are larger than the dimensions of the second inclined surfaces 13*b*, 14*b*, 15*b*, 16*b* in the thickness direction Z1.

Figure 13:
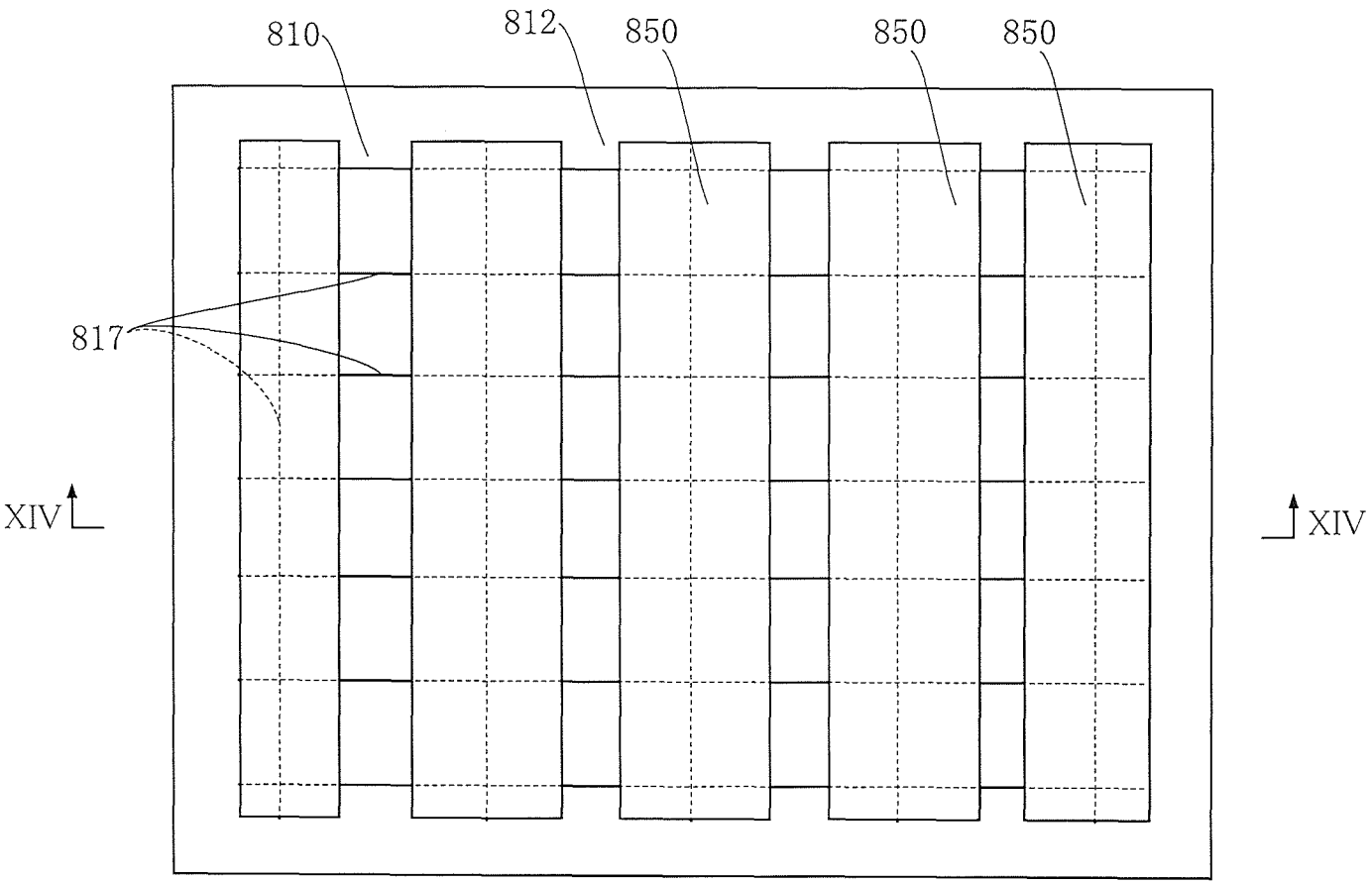
FIG. 13 is a reverse side view showing a step subsequent to FIG. 12.
Figure 14:
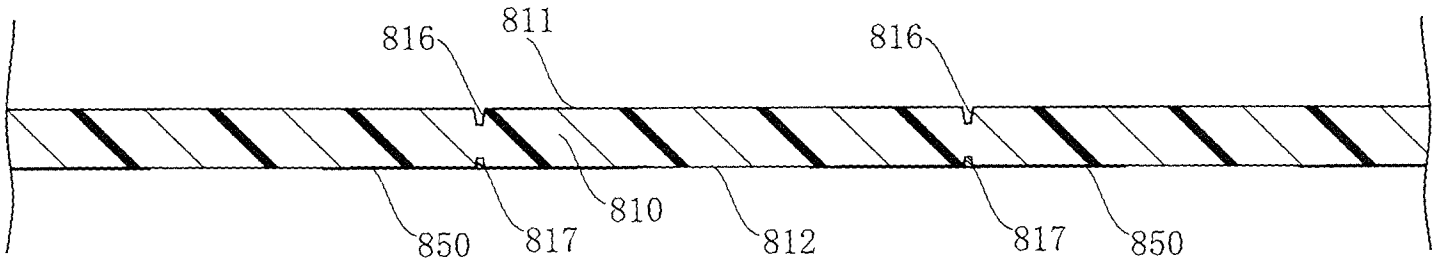
FIG. 14 is a sectional view taken along lines XIV-XIV in FIG. 13.

Then, as shown in FIGS. 13 and 14, a base layer 850 is formed on the sheet reverse surface 812 of the substrate sheet 810. The base layer 850 is made of an electrically conductive material and to become the above-described first base layer 41 and the second base layer 51. The base layer 850 is formed in the form of a plurality of strips elongated in one direction. For instance, the base layer 850 is formed by printing and baking. Part of the base layer 850 is formed in the grooves 817. Thus, as described above, the first base layer 41 is formed on the second inclined surface 13*b*, a part of the second inclined surface 15*b* and a part of the second inclined surface 16*b*. Similarly, the second base layer 51 is formed on the second inclined surface 14*b*, a part of the second inclined surface 15*b* and a part of the second inclined surface 16*b*.

Figure 15:
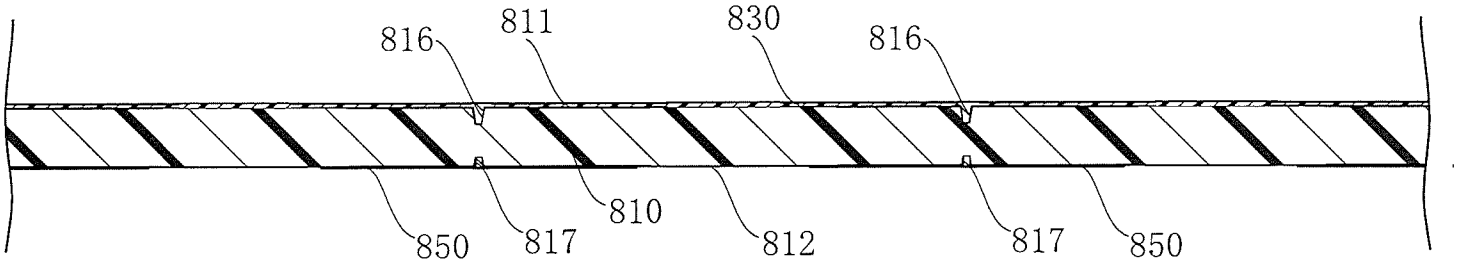
FIG. 15 is a sectional view showing a step subsequent to FIG. 14.

Then, as shown in FIG. 15, a bonding material 830 is bonded to the sheet obverse surface 811 of the substrate sheet 810. The bonding material 830 is to become the above-described bonding layer 3. In this embodiment, the bonding material 830 is a heat conductive adhesive sheet. In the state shown in FIG. 15, the bonding material 830 is temporarily bonded to the sheet obverse surface 811 of the substrate sheet 810 by thermocompression bonding. Part of the bonding material 830 is loaded in the grooves 816. Thus, as described above, the bonding layer 3 covers the first inclined surfaces 13*a*, 14*a*, 15*a* and 16*a*.

Figure 16:
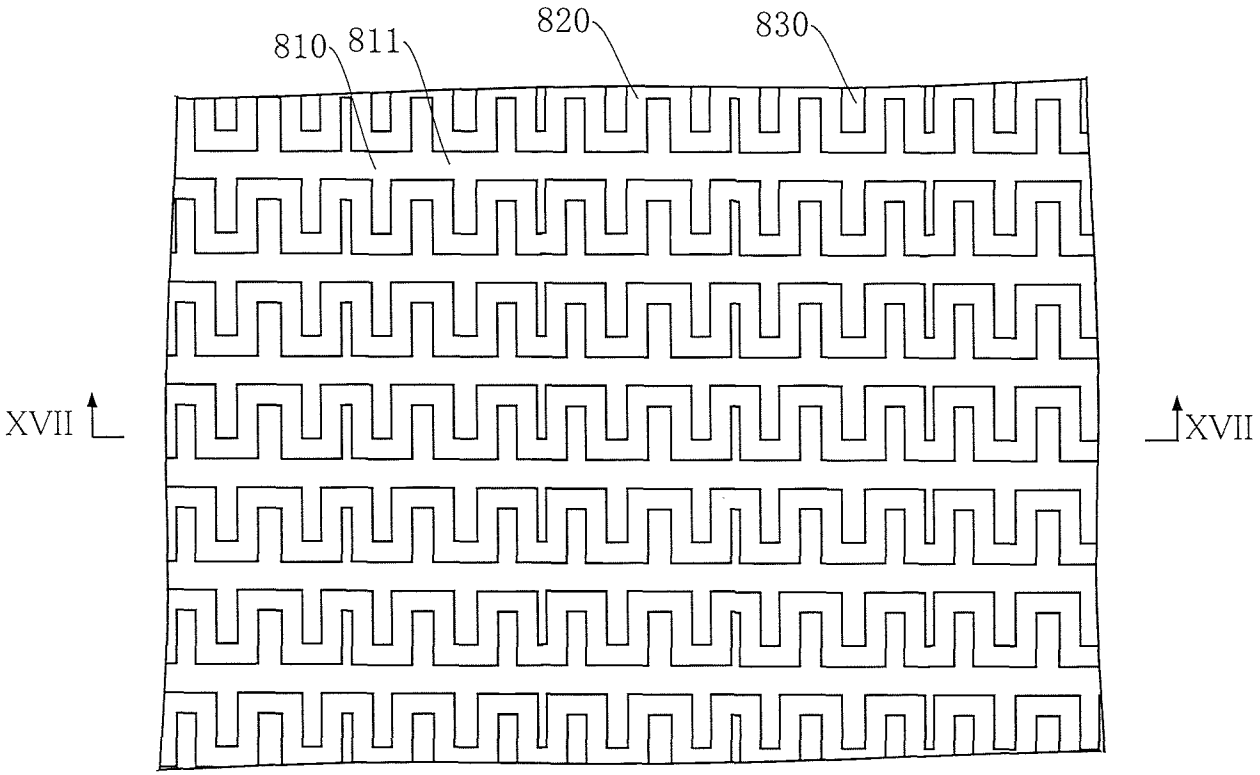
FIG. 16 is a plan view showing a step subsequent to FIG. 15.
Figure 17:
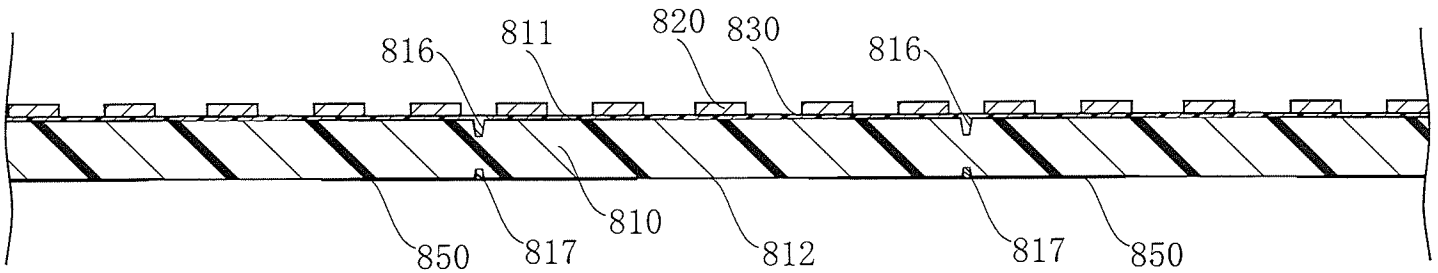
FIG. 17 is a sectional view taken along lines XVII-XVII in FIG. 16.

Then, as shown in FIGS. 16 and 17, the resistor element material 820 is bonded to the sheet obverse surface 811 by the bonding material 830. In this embodiment, in the state shown in FIGS. 16 and 17, the resistor element material 820 is temporarily pressure-bonded to the bonding material 830. The resistor element material 820 has a plurality of portions which are to become the above-described resistor elements 2. In this embodiment, to make the resistor element 2 in the form of a serpentine, a plurality of serpentine portions are formed in the resistor element material 820 by etching or with a punching die before the resistor element material 820 is bonded to the sheet obverse surface 811. Then, the resistor element material 820 is subjected to trimming (not shown) for adjusting the resistance of the resistor element 2. For instance, the trimming is performed by using laser, a sandblast, a dicer or a grinder.

Unlike this embodiment, the resistor element material 820 may be bonded to the sheet obverse surface 811 of the substrate sheet 810 by using an adhesive in a liquid state as the bonding material 830, instead of a sheet member.

Figure 18:
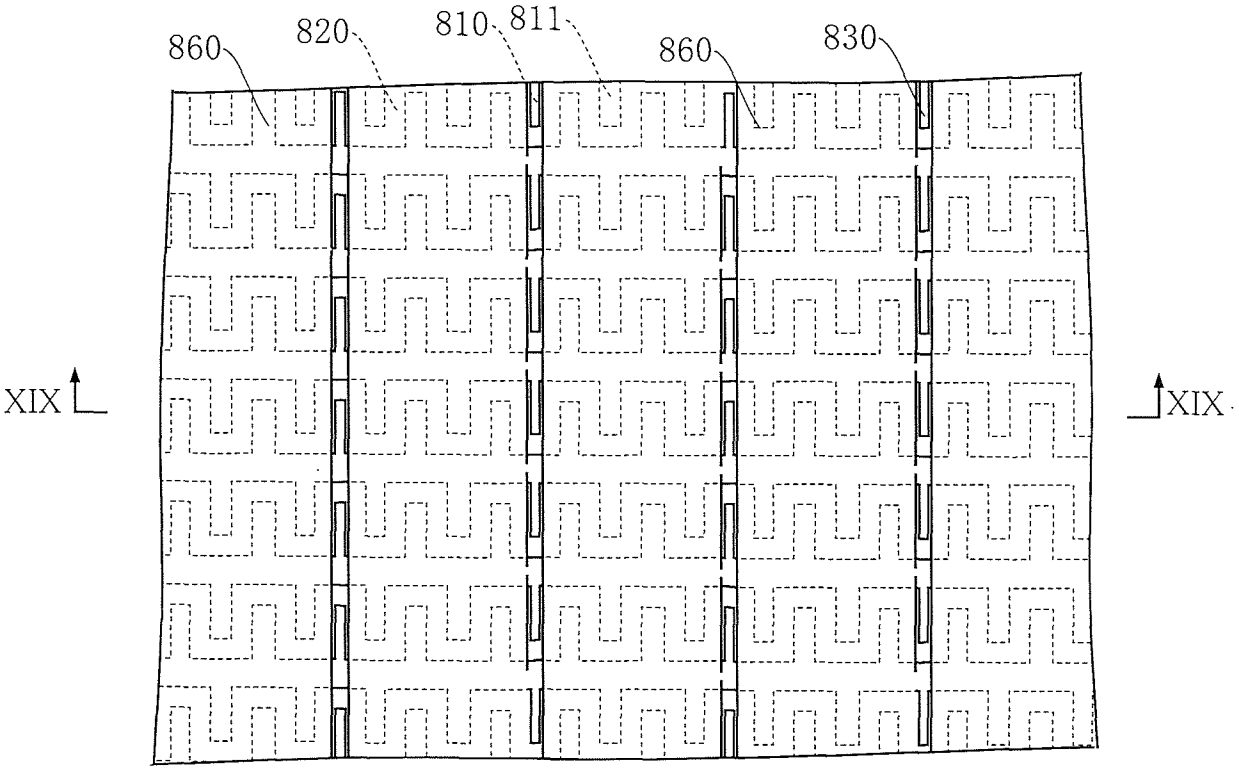
FIG. 18 is a plan view showing a step subsequent to FIG. 16.
Figure 19:
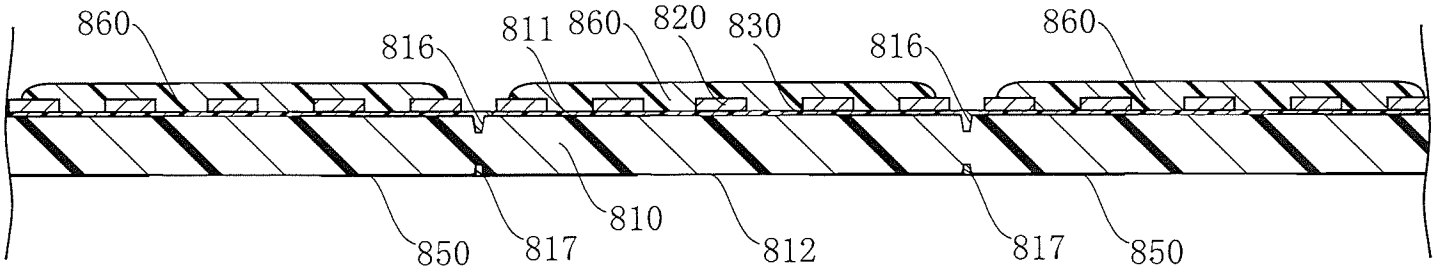
FIG. 19 is a sectional view taken along lines XIX-XIX in FIG. 18.

Then, as shown in FIGS. 18 and 19, an insulating protective film 860 is formed. The protective film 860 is to become the above-described protective film 6. The protective film 860 is formed as a plurality of strips elongated in one direction. For instance, the protective film 860 is formed by printing or other application methods. Then, though not illustrated, the intermediate product shown in FIGS. 18 and 19 is hardened at e.g. 150-170° C.

Figure 20:
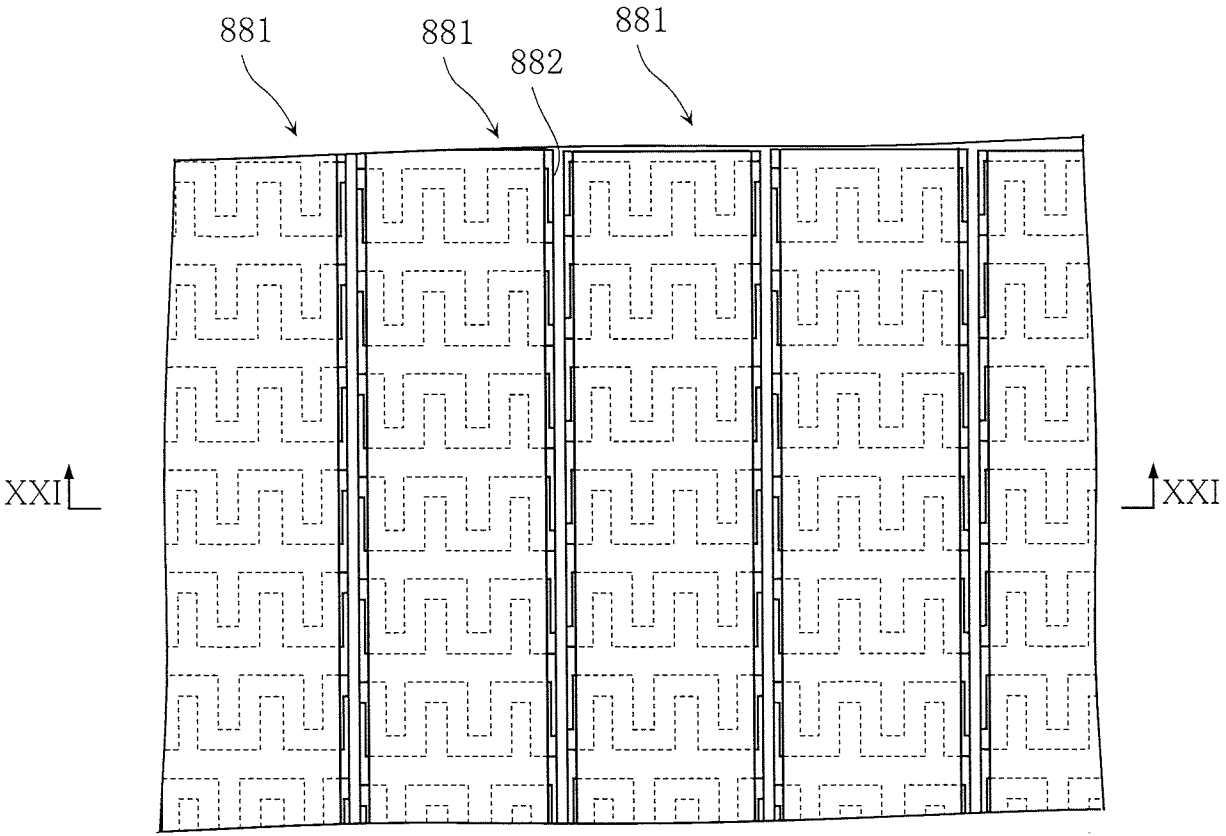
FIG. 20 is a plan view showing a step subsequent to FIG. 18.
Figure 21:
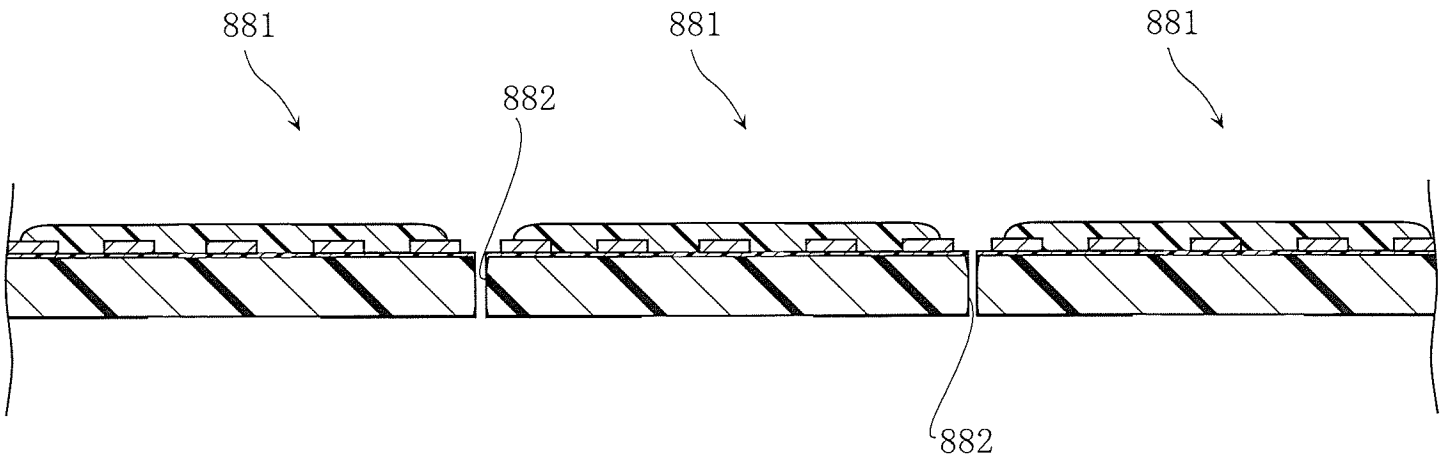
FIG. 21 is a sectional view taken along lines XXI-XXI in FIG. 20.

Then, as shown in FIGS. 20 and 21, the substrate sheet 810 is divided into a plurality of bars 881. Each of the bars 881 has an elongated bar side surface 882. The bar side surface 882 mainly becomes the above-described first substrate side surface 13 or the second substrate side surface 14. In this embodiment, the substrate sheet 810 is divided by bending the substrate sheet 810 along the above-described grooves 816 and grooves 817.

Figure 22:
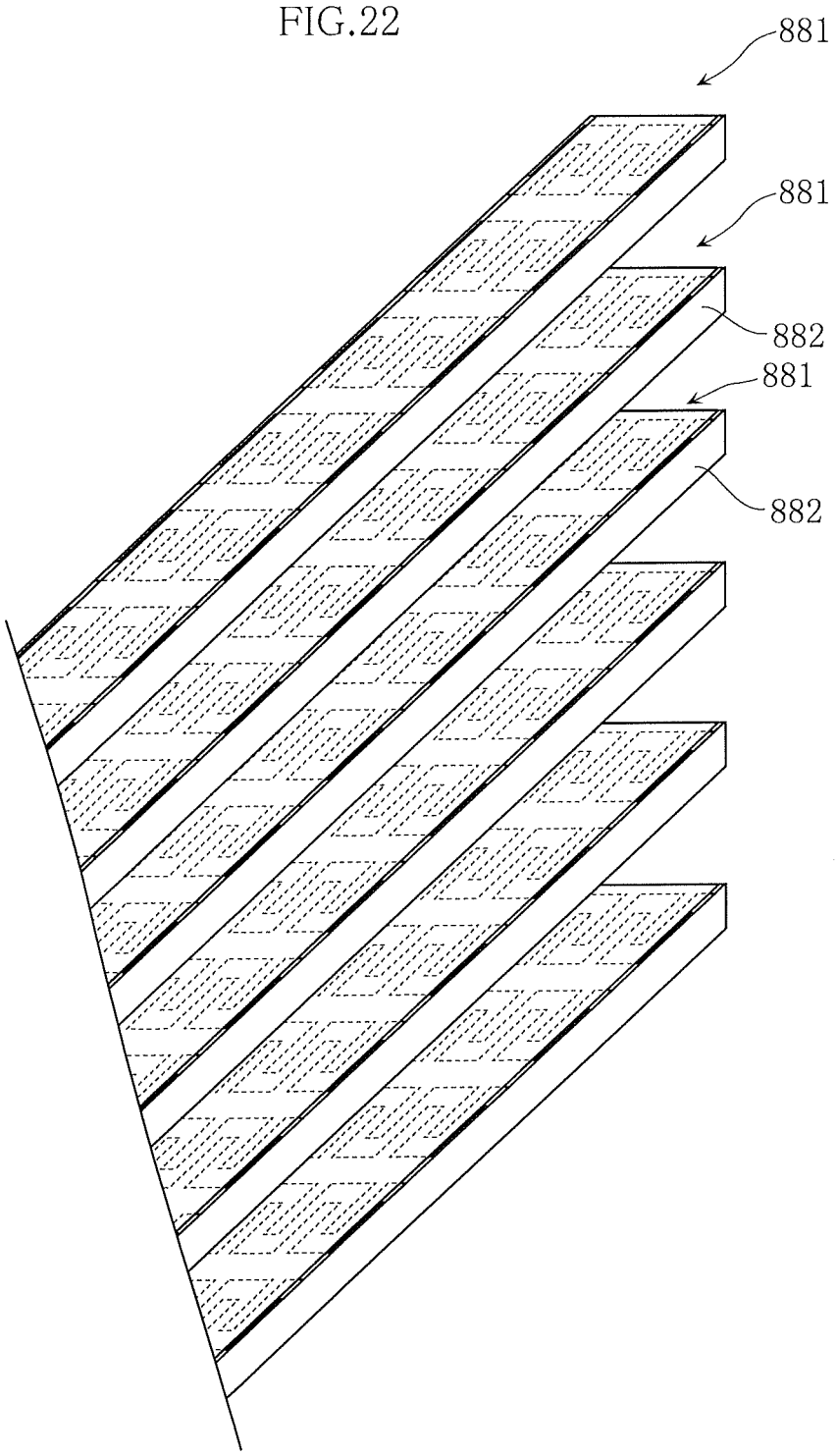
FIG. 22 is a perspective view showing a step subsequent to FIG. 20.
Figure 23:
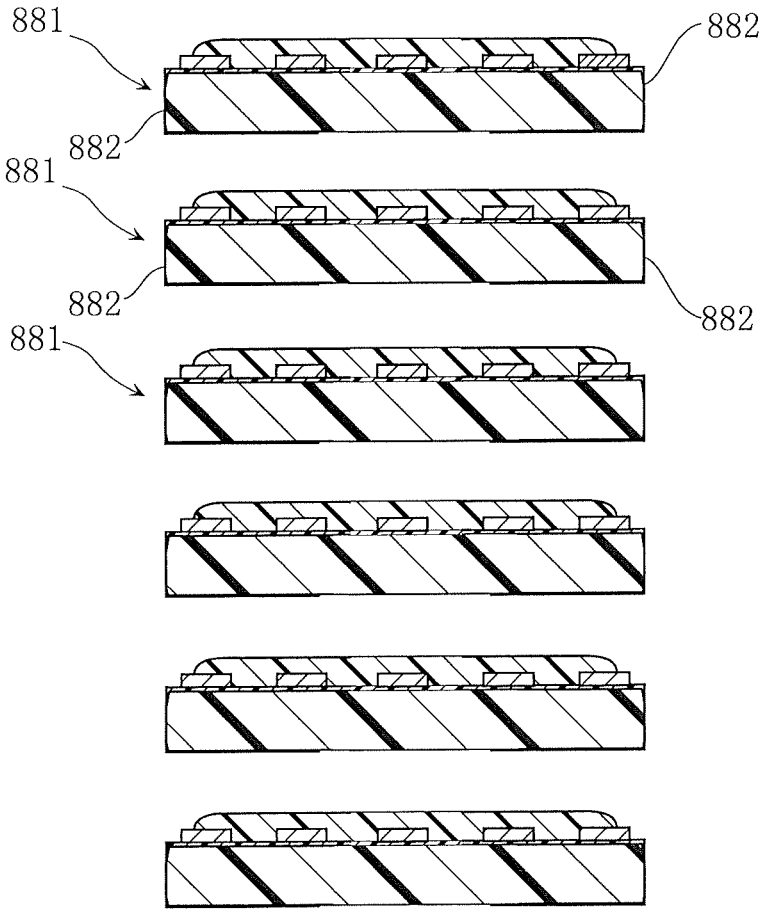
FIG. 23 is a sectional view of FIG. 22.
Figure 24:
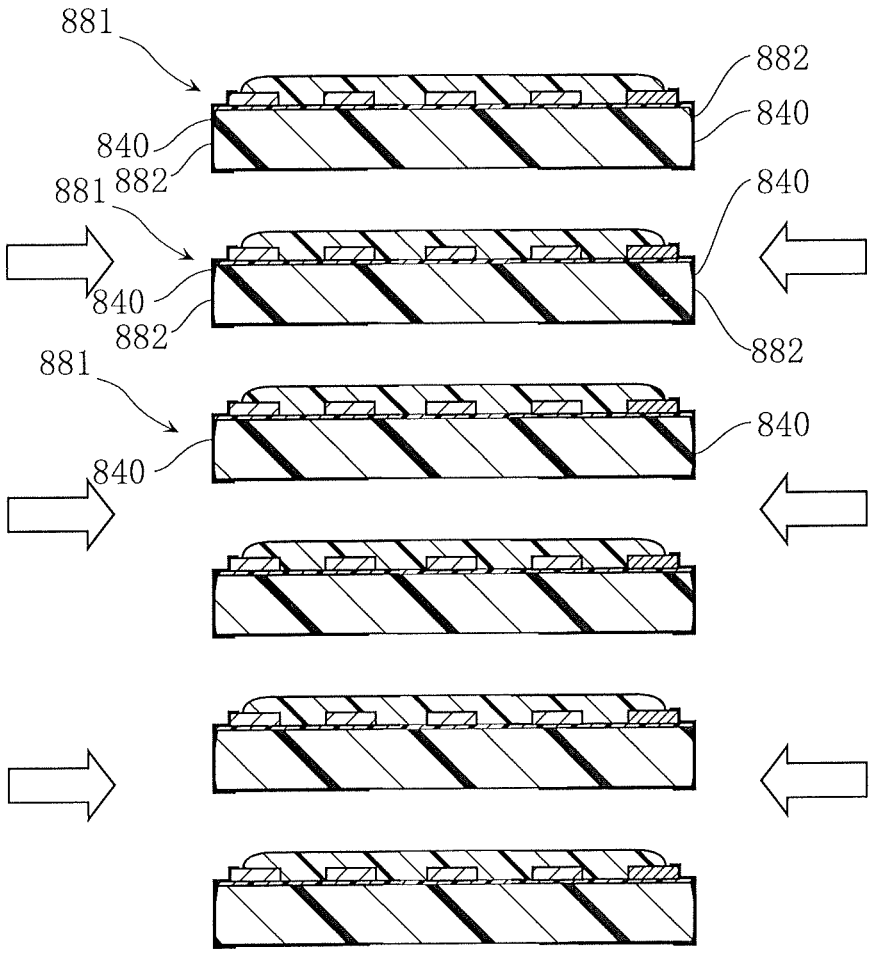
FIG. 24 is a sectional view showing a step subsequent to FIG. 23.

Then, as shown in FIGS. 22 and 23, the bars 881 are arranged so as to overlap each other. Then, as shown in FIG. 24, an electrically conductive material 840 is applied to the bar side surfaces 882. The electrically conductive material 840 is to become the above-described first connecting layer 42 or the second connecting layer 52. For instance, the application of the electrically conductive material 840 is performed by PVD or CVD. For instance, sputtering may be employed as the PVD for applying the electrically conductive material 840. In this embodiment, in the step of applying the electrically conductive material 840, the electrically conductive material 840 is collectively applied to the side surfaces 882 of the bars 881. For instance, the electrically conductive material 840 is Ni or Cr.

Figure 25:
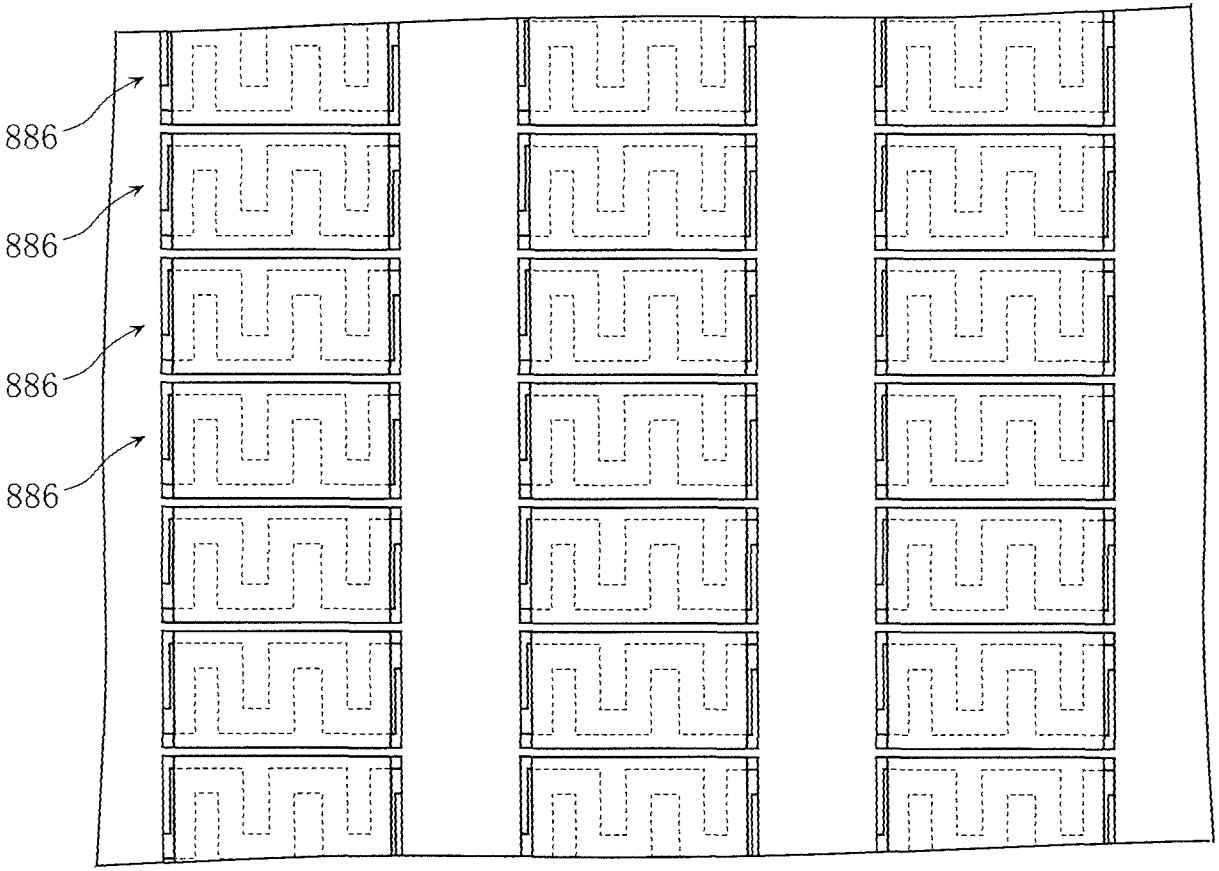
FIG. 25 is a plan view showing a step subsequent to FIG. 24.

Then, as shown in FIG. 25, each of the bars is divided in the width direction 8 of the bars 881 (horizontal direction in FIG. 25) into individual pieces 886. Specifically, the bar 881 is divided into individual pieces 886 by bending the bar 881 along the grooves 816 and grooves 817. By this process, the above-described third substrate side surface 15 and fourth substrate side surface 16 are provided.

Then, the first plating layer 43 (Cu layer 43*a*, Ni layer 43*b* and Sn layer 43*c*) and the second plating layer 53 (Cu layer 53*a*, Ni layer 53*b* and Sn layer 53*c*) shown in FIGS. 9 and 10 are formed on the individual piece 886. The first plating layer 43 and the second plating layer 53 may be formed by barrel plating. By performing the above-described steps, the chip resistor 100 is completed.

The advantages of this embodiment are described below.

In this embodiment, the chip resistor 100 includes the insulating substrate 1, the resistor element 2 and the bonding layer 3. The resistor element 2 is arranged on the substrate obverse surface 11 of the substrate 1. The bonding layer 3 is provided between the resistor element 2 and the substrate obverse surface 11. According to this arrangement, the strength of the chip resistor 100 is maintained by the substrate 1 even when the thickness of the resistor element 2 is reduced. Thus, it is possible to increase the resistance of the resistor element 2 (resistance of the chip resistor 100) while keeping the strength of the chip resistor 100.

In this embodiment, the first electrode 4 includes the first base layer 41 and the first connecting layer 42. The first base layer 41 is formed on the substrate reverse surface 12. The first connecting layer 42 directly covers the first base layer 41, the first substrate side surface 13 and the resistor element 2. According to this arrangement, the first electrode 4 has a relatively large area on the substrate reverse surface 12. Thus, heat generated at the resistor element 2 dissipates to the outside of the chip resistor 100 through the area of the first electrode 4 on the substrate reverse surface 12. Thus, the chip resistor 100 has enhanced heat dissipation efficiency.

Also, in this embodiment, the second electrode 5 includes the second base layer 51 and the second connecting layer 52. The second base layer 51 is formed on the substrate reverse surface 12. The second connecting layer 52 directly covers the second base layer 51, the second substrate side surface 14 and the resistor element 2. According to this arrangement, the second electrode 5 has a relatively large area on the substrate reverse surface 12. Thus, heat generated at the resistor element 2 dissipates to the outside of the chip resistor 100 through the area of the second electrode 5 on the substrate reverse surface 12. Thus, the chip resistor 100 has enhanced heat dissipation efficiency.

In this embodiment, the first connecting layer 42 is 0.5-1.0 nm in thickness, because the layer is formed by the thin film formation technique such as PVD or CVD. Using the thin film formation technique such as PVD or CVD makes it possible to make the first connecting layer 42 from a material that does not contain resin. Thus, the first connecting layer 42 is prevented from having an unintended resistance. As a result, the chip resistor 100 having a desired resistance is provided.

In this embodiment, the second connecting layer 52 is 0.5-1.0 nm in thickness, because the layer is formed by the thin film formation technique such as PVD or CVD. Using the thin film formation technique such as PVD or CVD makes it possible to make the second connecting layer 52 from a material that does not contain resin. Thus, the second connecting layer 52 is prevented from having an unintended resistance. As a result, the chip resistor 100 having a desired resistance is provided.

The present invention is not limited to the foregoing embodiment. The specific structure of each part of the present invention may be varied in design in many ways.

The invention claimed is:

1. A chip resistor comprising:

an insulating substrate including a substrate obverse surface, a substrate reverse surface and a first substrate side surface, the substrate obverse surface and the substrate reverse surface being spaced apart from each other in a thickness direction of the substrate, the first substrate side surface being configured to face in a first direction perpendicular to the thickness direction;

a resistor element arranged on the substrate obverse surface;

a bonding layer provided between the resistor element and the substrate obverse surface;

a first electrode connected to the resistor element; and a second electrode connected to the resistor element, the second electrode being deviated from the first electrode in a second direction opposite from the first direction;

wherein the first electrode includes a base layer and a connecting layer, the base layer being formed on the substrate reverse surface, the connecting layer electrically connecting the base layer to the resistor element, and the resistor element includes a resistor element obverse surface facing in a same direction as the substrate obverse surface, and the resistor element obverse surface is directly covered by the connecting layer.

2. The chip resistor according to claim 1, wherein the connecting layer directly covers the base layer, the first substrate side surface and the resistor element.

3. The chip resistor according to claim 1, wherein the base layer is provided between the connecting layer and the substrate reverse surface.

4. The chip resistor according to claim 1, wherein the connecting layer is 0.5-1.0 nm in thickness.

5. The chip resistor according to claim 1, wherein the connecting layer is formed by PVD or CVD.

6. The chip resistor according to claim 5, wherein the PVD comprises sputtering.

7. The chip resistor according to claim 1, wherein the resistor element is serpentine as viewed in the thickness direction of the substrate.

8. The chip resistor according to claim 1, wherein the resistor element includes a resistor element side surface facing in the first direction, the resistor element side surface being directly covered by the connecting layer.

9. The chip resistor according to claim 1, wherein the first electrode includes a plating layer covering the connecting layer.

10. The chip resistor according to claim 9, wherein the plating layer includes a Cu layer covering the connecting layer, an Ni layer covering the Cu layer and an Sn layer covering the Ni layer.

11. The chip resistor according to claim 1, wherein the substrate includes a second substrate side surface facing in the second direction, and the second electrode covers the resistor element, the second substrate side surface and the substrate reverse surface.

12. The chip resistor according to claim 11, wherein the substrate includes a third substrate side surface and a fourth substrate side surface facing away from each other, the third substrate side surface facing in a third direction perpendicular to the thickness direction of the substrate and the first direction, both of the third substrate side surface and the fourth substrate side surface being exposed.

13. The chip resistor according to claim 1, further comprising an insulating protective film covering the resistor element, wherein the protective film is held in direct contact with the first electrode and the second electrode.

14. The chip resistor according to claim 1, wherein the base layer is made of Ag.

15. The chip resistor according to claim 1, wherein the substrate is made of a ceramic material or a resin.

16. The chip resistor according to claim 1, wherein the bonding layer is made of an epoxy-based material.

17. The chip resistor according to claim 1, wherein the resistor element is made of Ni—Cr alloy, Cu—Ni alloy or Fe—Cr alloy.

18. A method for making a chip resistor as set forth in claim 1, the method comprising the steps of:

preparing an insulating substrate sheet; and bonding a resistor element material on an obverse surface of the insulating substrate sheet by using a bonding material.

19. The method according to claim 18, further comprising the step of forming an electrically conductive base layer on a reverse surface of the substrate sheet.

20. The method according to claim 19, wherein the step of forming the base layer is performed by printing.

21. The method according to claim 19, wherein the base layer is made of Ag.

22. The method according to claim 18, wherein the bonding material comprises an adhesive sheet or a liquid adhesive.

23. The method according to claim 18, further comprising the step of forming an insulating protective film for covering the resistor element material.

24. The method according to claim 18, further comprising the step of dividing the substrate sheet into a plurality of bars.

25. The method according to claim 24, wherein each of the bars includes an elongated bar side surface and the method further comprises the step of applying an electrically conductive material to the bar side surface of each bar.

26. The method according to claim 25, wherein the step of applying an electrically conductive material is performed by PVD or CVD.

27. The method according to claim 26, wherein the PVD comprises sputtering.

28. The method according to claim 25, wherein the electrically conductive material is collectively to the bar side surfaces of the plurality of bars.

29. The method according to claim 24, wherein a plurality of grooves are formed in the obverse surface and the reverse surface of the substrate sheet, and the step of dividing into a plurality of bars comprises dividing the substrate sheet along the grooves.

30. The method according to claim 29, further comprising the step of dividing the bars along a width direction of the bars to obtain individual pieces.

31. The method according to claim 30, further comprising the step of forming a plating layer on each of the individual pieces.

32. A chip resistor comprising:

an insulating substrate including a substrate obverse surface, a substrate reverse surface and a first substrate side surface, the substrate obverse surface and the substrate reverse surface being spaced apart from each other in a thickness direction of the substrate, the first substrate side surface being configured to face in a first direction perpendicular to the thickness direction;

a resistor element arranged on the substrate obverse surface;

a bonding layer provided between the resistor element and the substrate obverse surface;

a first electrode connected to the resistor element; and a second electrode connected to the resistor element, the second electrode being deviated from the first electrode in a second direction opposite from the first direction, wherein the bonding layer includes a bonding layer obverse surface facing in a same direction as the substrate obverse surface, and the bonding layer obverse surface is held in direct contact with the resistor element, the first electrode includes a base layer and a connecting layer, the base layer being formed on the substrate reverse surface, the connecting layer electrically connecting the base layer to the resistor element, and the resistor element has a resistor element side surface that faces in the first direction, the bonding layer obverse surface includes a region deviated from the resistor element side surface in the first direction, the region being directly covered by the connecting layer.

33. A chip resistor comprising:

an insulating substrate including a substrate obverse surface, a substrate reverse surface and a first substrate side surface, the substrate obverse surface and the substrate reverse surface being spaced apart from each other in a thickness direction of the substrate, the first substrate side surface being configured to face in a first direction perpendicular to the thickness direction;

a resistor element arranged on the substrate obverse surface;

a bonding layer provided between the resistor element and the substrate obverse surface;

a first electrode connected to the resistor element; and a second electrode connected to the resistor element, the second electrode being deviated from the first electrode in a second direction opposite from the first direction, wherein the first electrode includes a base layer and a connecting layer, the base layer being formed on the substrate reverse surface, the connecting layer electrically connecting the base layer to the resistor element, and the substrate includes a first inclined surface inclined with respect to the thickness direction so as to form an obtuse angle with the substrate obverse surface, and the first inclined surface is connected to the substrate obverse surface and the first substrate side surface and covered by the bonding layer.

34. The chip resistor according to claim 33, wherein the substrate includes a second inclined surface inclined with respect to the thickness direction so as to form an obtuse angle with the substrate reverse surface, and the second inclined surface is connected to the substrate reverse surface and the first substrate side surface and covered by the base layer.

35. The chip resistor according to claim 34, wherein a dimension of the first inclined surface in the thickness direction of the substrate is larger than a dimension of the second inclined surface in the thickness direction of the substrate.

* * * * *